US011959300B2

(12) United States Patent
Bechtol et al.

(10) Patent No.: US 11,959,300 B2
(45) Date of Patent: Apr. 16, 2024

(54) FLOOR STRUCTURE SYSTEM AND METHOD OF USE

(71) Applicant: Bil-Jax, Inc., Archbold, OH (US)

(72) Inventors: Earl Bechtol, Defiance, OH (US); Sean Michael Deacy, Winchester, MA (US); Brian Kordek, Port St. Lucie, FL (US)

(73) Assignee: Bil-Jax, Inc., Archbold, OH (US)

( * ) Notice: Subject to any disclaimer, the term of this patent is extended or adjusted under 35 U.S.C. 154(b) by 248 days.

(21) Appl. No.: 17/446,680

(22) Filed: Sep. 1, 2021

(65) Prior Publication Data

US 2022/0064975 A1 Mar. 3, 2022

Related U.S. Application Data

(60) Provisional application No. 63/073,466, filed on Sep. 2, 2020.

(51) Int. Cl.

| | |
|---|---|
| ***E04H 3/24*** | (2006.01) |
| ***E04H 3/28*** | (2006.01) |
| ***E04H 15/56*** | (2006.01) |

(52) U.S. Cl.

CPC ..... *E04H 3/24* (2013.01); *E04H 3/28* (2013.01); *E04H 15/56* (2013.01)

(58) Field of Classification Search

CPC ... E04H 3/24; E04H 3/28; E04H 15/56; E04F 15/02452; E04F 15/02458; E04B 5/10; E04B 5/14

See application file for complete search history.

(56) References Cited

U.S. PATENT DOCUMENTS

| | | | |
|---|---|---|---|
| 1,586,053 | A | 5/1926 | Snyder |
| 3,130,470 | A | 4/1964 | Bowden et al. |
| 3,221,466 | A | 12/1965 | Downing, Jr. et al. |
| 3,316,680 | A | 5/1967 | Chrastek |
| 3,628,628 | A | 12/1971 | Gilbreath et al. |
| 3,722,167 | A | 3/1973 | Rousey |
| 3,752,262 | A | 8/1973 | Helms |
| 3,811,237 | A | 5/1974 | Bettinger |
| 3,924,370 | A | 12/1975 | Caucelglia et al. |

(Continued)

FOREIGN PATENT DOCUMENTS

| | | | |
|---|---|---|---|
| CA | 2705360 | A1 | 5/2009 |
| CA | 2758997 | A1 | 10/2010 |

(Continued)

OTHER PUBLICATIONS

40×80 Frame Tent Victoria BC by Rental Newtwork Ltd. Rental Network Ltd, Jan. 2, 2015 (Jan. 2, 2015 [online], [retreived on Oct. 18, 2016], Retreived from the internet; <URL:https://www.youtube.com/watch?v=C0YqEGnCn5c>.

(Continued)

*Primary Examiner* — Michael Safavi

(74) *Attorney, Agent, or Firm* — Marshall & Melhorn, LLC

(57) ABSTRACT

A floor structure system may have a hub with a plate with an upper surface. A beam connector may be connected to the upper surface. At least one pin may extend from the upper surface. The pin may be adapted to connect with a rod or a cable extending generally transverse the pin direction. The rod or cable may have an aperture adapted to receive the at least one pin. The system may also have a beam attached to the beam connector.

13 Claims, 13 Drawing Sheets

(56) References Cited

U.S. PATENT DOCUMENTS

| | | | | |
|---|---|---|---|---|
| 3,927,498 | A | 12/1975 | Benedetti | |
| 4,630,417 | A | 12/1986 | Collier | |
| 4,633,626 | A | 1/1987 | Freeman et al. | |
| 4,635,413 | A | 1/1987 | Hansen et al. | |
| 4,730,428 | A | 3/1988 | Head et al. | |
| 4,759,162 | A | 7/1988 | Wyse | |
| 4,850,162 | A | 7/1989 | Albrecht | |
| 4,984,654 | A | 1/1991 | Anderson | |
| 5,048,242 | A | 9/1991 | Cline | |
| 5,058,352 | A | 10/1991 | Loiselle et al. | |
| 5,060,426 | A | 10/1991 | Jantzen | |
| 5,226,440 | A | 7/1993 | Fuhrman | |
| 5,317,842 | A * | 6/1994 | Rogers | F16B 9/05 52/126.5 |
| 5,323,563 | A * | 6/1994 | Rogers | E04H 3/28 52/126.6 |
| 5,778,999 | A | 7/1998 | Nealeigh | |
| 5,787,663 | A | 8/1998 | Wehrmann | |
| 5,791,096 | A * | 8/1998 | Chen | E04F 15/02452 52/220.1 |
| 5,848,501 | A | 12/1998 | Taipale et al. | |
| 6,276,111 | B1 | 8/2001 | Pittman, Sr. et al. | |
| 7,360,343 | B1 | 4/2008 | Spransy et al. | |
| 7,389,614 | B2 | 6/2008 | Sullivan | |
| 7,500,335 | B1 | 3/2009 | Kjose | |
| 7,707,780 | B2 | 5/2010 | Ouellet et al. | |
| 7,874,115 | B2 | 1/2011 | Thiede | |
| 8,215,063 | B1 | 7/2012 | Francis | |
| 8,479,459 | B2 | 7/2013 | Tucker | |
| 8,584,404 | B2 | 11/2013 | Heidenreich | |
| 9,506,248 | B1 | 11/2016 | Fields et al. | |
| 2003/0167701 | A1 | 9/2003 | Rich | |
| 2004/0211137 | A1 | 10/2004 | Thiede | |
| 2006/0115324 | A1 | 6/2006 | Zenda et al. | |
| 2007/0094962 | A1 | 5/2007 | Schwoerer | |
| 2008/0053003 | A1 | 3/2008 | Hockemeyer et al. | |
| 2008/0053017 | A1 | 3/2008 | Hockemeyer et al. | |
| 2008/0053018 | A1 | 3/2008 | Hockemeyer et al. | |
| 2008/0053032 | A1 | 3/2008 | Hockemeyer et al. | |
| 2008/0263968 | A1 | 10/2008 | Day | |
| 2009/0212195 | A1 | 8/2009 | Arocena Bergareche et al. | |
| 2011/0290588 | A1 | 12/2011 | Hall et al. | |
| 2012/0005969 | A1 | 1/2012 | Broden | |
| 2012/0031017 | A1 | 2/2012 | Stroyer | |
| 2012/0233961 | A1 | 9/2012 | Matos | |
| 2013/0014466 | A1 | 1/2013 | Eggers | |
| 2013/0101343 | A1* | 4/2013 | Chase | F16B 12/02 403/322.4 |
| 2014/0123576 | A1 | 5/2014 | Meyer | |
| 2014/0262619 | A1 | 9/2014 | Bains | |
| 2015/0033661 | A1* | 2/2015 | Chase | E04H 3/24 52/655.1 |
| 2015/0121800 | A1 | 5/2015 | Cipriani | |
| 2015/0337532 | A1 | 11/2015 | Cipriani | |
| 2016/0208507 | A1* | 7/2016 | Davis | E04H 3/28 |
| 2017/0051526 | A1* | 2/2017 | Francis | E04G 1/08 |
| 2017/0321413 | A1 | 11/2017 | Pridham | |
| 2018/0135321 | A1 | 5/2018 | Francis | |
| 2020/0131798 | A1 | 4/2020 | Francis | |
| 2020/0362587 | A1* | 11/2020 | Francis | E04B 1/34352 |
| 2022/0098895 | A1* | 3/2022 | Wyse | E04B 5/023 |

FOREIGN PATENT DOCUMENTS

| | | | | |
|---|---|---|---|---|
| CA | 2905148 | A1 * | 3/2017 | E04B 1/003 |
| CA | 2932677 | A1 | 12/2017 | |
| DE | 9101717 | U1 | 12/1991 | |
| DE | 29520623 | U1 | 2/1996 | |
| DE | 19911380 | A1 * | 9/2000 | E04G 1/15 |
| DE | 10100399 | A1 * | 7/2002 | E04B 5/14 |
| DE | 10209976 | A1 | 10/2003 | |
| EP | 0167509 | A2 | 1/1986 | |
| EP | 0167509 | A2 * | 1/1986 | E04H 15/56 |
| EP | 393317 | A | 10/1990 | |
| EP | 2305922 | A2 * | 4/2011 | E04H 3/24 |
| EP | 2304134 | B1 | 3/2017 | |
| FR | 2418319 | A * | 10/1979 | A63J 1/00 |
| FR | 2585752 | A1 | 2/1987 | |
| FR | 2585752 | A1 * | 2/1987 | E04H 3/24 |
| FR | 2679585 | A1 * | 1/1993 | E04H 3/12 |
| GB | 1489411 | A | 10/1997 | |
| JP | 2004270432 | A | 9/2004 | |
| KR | 101470875 | B1 * | 12/2014 | E04H 15/56 |
| KR | 1571247 | B1 * | 11/2015 | A47B 37/04 |
| KR | 102003969 | B1 | 7/2019 | |
| WO | 9117330 | A1 | 11/1991 | |
| WO | WO-9303240 | A2 * | 2/1993 | E04H 3/126 |
| WO | WO-2012017458 | A1 * | 2/2012 | E04F 15/02044 |
| WO | 2016080618 | A1 | 5/2016 | |
| WO | WO-2018186756 | A1 * | 10/2018 | |
| WO | WO-2020208351 | A1 * | 10/2020 | E04G 7/22 |

OTHER PUBLICATIONS

TF-2100 Tent Flooring Systems Assembly Instructions, Biljax Event Solutions. Dec. 18, 2015 (Dec. 18, 2015) [online], [retrieved on Oct. 14, 2016], Retrieved from the internet: <URL:http//www.biljax.com/clientuploads/Catalogs/Event/TF2100%20Asembly%20Instructions.pdf>.

TF2100 Biljax Video HD 1080p. Biljax Scaffold and Event Solutions, Oct. 2, 2015 (Oct. 2, 2015) [online], [retrieved on Oct. 14, 2016], Retrieved from the internet: <URL: https://www.youtube.com/watch?v=K1eFWSDhKLY>.

Canadian Intellctual Property Office, Examiner's Report in application No. CA3129597, dated Dec. 6, 2022, 5 pages, Gatineau, Quebec, Canada.

* cited by examiner

FLOOR STRUCTURE SYSTEM AND METHOD OF USE

FIELD

A floor structure system and method of use are provided. The system may be used with tent structures, but is not limited to such structures.

BACKGROUND

Flooring systems for tents and stages are known. In some cases, these systems are designed to extend over uneven ground, which can include ground with elevation changes of several feet. While these systems are well adapted for uneven ground, the components of these system do not let them easily adapt to relatively flat ground or ground with smaller elevation changes. When these existing systems are used, they result in structures that are often elevated too far off the ground and/or use components that are not needed for even ground installations. This may result in a flooring system that is not optimized in performance and/or cost for the task.

Further, some of the existing flooring systems require the use of ground altering structures, such as stakes and spikes to anchor the systems in place. When a tent or stage flooring system is needed in a driveway or parking lot, however, it would be advantageous to not have to materially alter these structures.

In view of the disadvantages of the current flooring systems for tents and stages, it would be advantageous to have a system that can be adapted to relatively flat ground. It would also be advantageous for a flooring system to leave little to no permanent trace on the ground, driveway or parking lot on which it was located.

SUMMARY

In one aspect, a floor structure system may have a first hub having at least one pin and a first beam connector. The system may also have a second hub having at least one pin and a second beam connector. The system may also have at least one hub connecting member having a first end portion and a second end portion, where the first end portion may have an aperture adapted to receive the at least one pin of the first hub and where second end portion may have an aperture adapted to receive the at least one pin of the second hub. The system may also have a beam having a first end portion and a second end portion, where one of the end portions may be attached to one of the hubs.

In another aspect, the at least one pins of the first and second hubs may have circular cross sections and may be all of substantially equal height above upper surfaces of the hubs.

In another aspect, the first and second hubs may each have a plurality of pins, where each of the plurality of pins comprises first and second pin groups, where the groups may be separated by the respective beam connectors.

In another aspect, each of the pin groups may have two leading pins, two middle pins and a single rear pin.

In another aspect, the two leading pins of each of the pin groups may be aligned with one another, the two middle pins in each of the pin groups may be aligned with one another and the single rear pins in the pin groups may be aligned with one another.

In another aspect, the beam connectors may comprise two equally spaced apart parallel plates.

And, fasteners may extend through apertures in the parallel plates and the beam to secure them together.

In another aspect, the beam may have an upper surface, an opposite lower surface and two parallel side surfaces, where the side surfaces are located parallel and within the parallel plates.

In another aspect, the beam comprises lips that may extend transversely from the sides of the beam, where the lips may be located above the pins and above the beam connectors.

In another aspect, when the hub connecting member is at least one rod, the rod may have a longitudinal rod axis, where the first and second end portions of the rod may be offset from the longitudinal rod axis, and when the hub connecting member is a cable, the cable has a longitudinal cable axis coaxial the first and second end portions. In another aspect, the aperture in the first and second end portions in the rod may be located in flat plate portions of the rod, and the at least one aperture in the first and second end portions for the cable may be formed by loops in the cable.

In another aspect, the hub connecting member may be a first rod or cable extending transverse the beam that may connect with a first pin in the first hub, and a second and third rod or cable may connect with second and third pins, respectively, on the first hub and extend between 30-60 degrees from the beam.

In another aspect, a gable upright connector may have a lower portion and an upper portion, where the lower portion may define at least one jaw and a stop plate, where the at least one jaw and the stop plate may be adapted to at least partially receive the beam between them and where the upper portion has an eye bolt aperture and a upright pin aperture extending transverse the eye bolt aperture.

In another aspect, a floor structure system may have a first hub that may have a first beam connector, where the first hub may have at least one pin adapted to connect with a first rod or a first cable. The system may also have a second hub that may have a second beam connector, where the second hub may have at least one pin adapted to connect with the first rod, the first cable, another rod or another cable. Further, the rods or cables may have an aperture adapted to receive at least one of the pins of either the first or second hubs. The system may also have a beam that may have a first end portion and a second end portion, wherein one of the end portions is attached to one of the first or second beam connector.

In another aspect, a floor structure system may have a hub that may have a plate with an upper surface, where a beam connector may be connected to the upper surface, and at least one pin may extend from the upper surface, where the at least one pin may be adapted to connect with a rod or a cable extending generally transverse the pin direction. Further, the rod or cable may have an aperture adapted to receive the at least one pin. The system may also have a beam attached to the beam connector.

BRIEF DESCRIPTION OF THE DRAWINGS

The above, as well as other advantages will become readily apparent to those skilled in the art from the following detailed description when considered in the light of the accompanying drawings in which.

DETAILED DESCRIPTION OF THE PREFERRED EMBODIMENTS

It is to be understood that the device may assume various alternative orientations and step sequences, except where expressly specified to the contrary. It is also to be understood that the specific devices and processes illustrated in the attached drawings, and described in the following specification are simply exemplary embodiments of the concepts defined herein. Hence, specific dimensions, directions or other physical characteristics relating to the embodiments disclosed are not to be considered as limiting, unless expressly stated otherwise.

Figure 1:
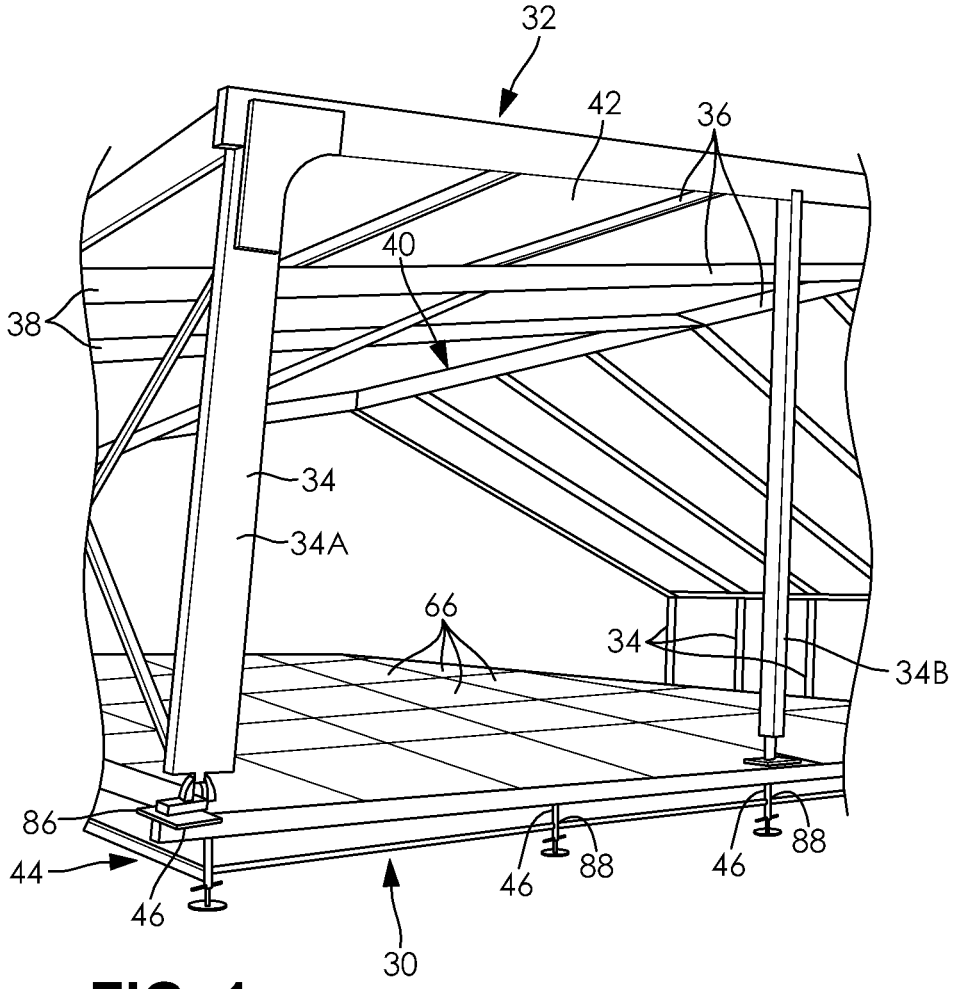
FIG. 1 is a perspective view of one embodiment of a floor system.

Turning now to FIG. 1, one embodiment of a floor system 30. The system 30 may be used with a tent structure 32, as show in FIG. 1, but it is not limited to such structures. While the system 30 is depicted with one version of a tent structure 32, such as a clear span tent structure, other applications with different sizes, shapes and orientations are permissible. Further, while the floor system 30 is adapted for clear span tent structures it may be used with other structures.

For example, the system 30 may also be used with frame tent structures. A frame tent structure might be comprised of a metal pole grid which supports the fabric of the tent. A metal pole grid is a lighter duty design than what is described herein and depicted in the figures but this design too may be used with the system 30 herein.

The tent structure 32 depicted in FIG. 1 may have a plurality of uprights 34. The uprights 34 extend from the floor system 30 and may connect with one another as well as with a roof structure 36. The uprights 34 are adapted to support the roof structure 36 and they may also help in forming the walls (not shown) of the tent structure 32. The uprights 34 may be pole or beam shaped and they may have different sizes and shapes compared to one another. Generally, the uprights 34 may be in three categories: eave uprights 34A, gable uprights 34B and interior gable uprights (note shown). The eave uprights 34A may be located adjacent walls of the tent structure 32. The interior gable uprights may be located on the interior of the structure 32, and the gable uprights 32B may be located adjacent end walls of the tent structure 32. The uprights 34 may be in different numbers and locations than shown in FIG. 1.

The roof structure 36 may be comprised of rafters 38 extending from the side walls to an apex portion 40. The rafters 38 support a covering 42 that typically extends from side to side and front to back of the tent structure 32; the covering 42 may extend substantially over the floor system 30, or only a portion thereof.

Figure 2:
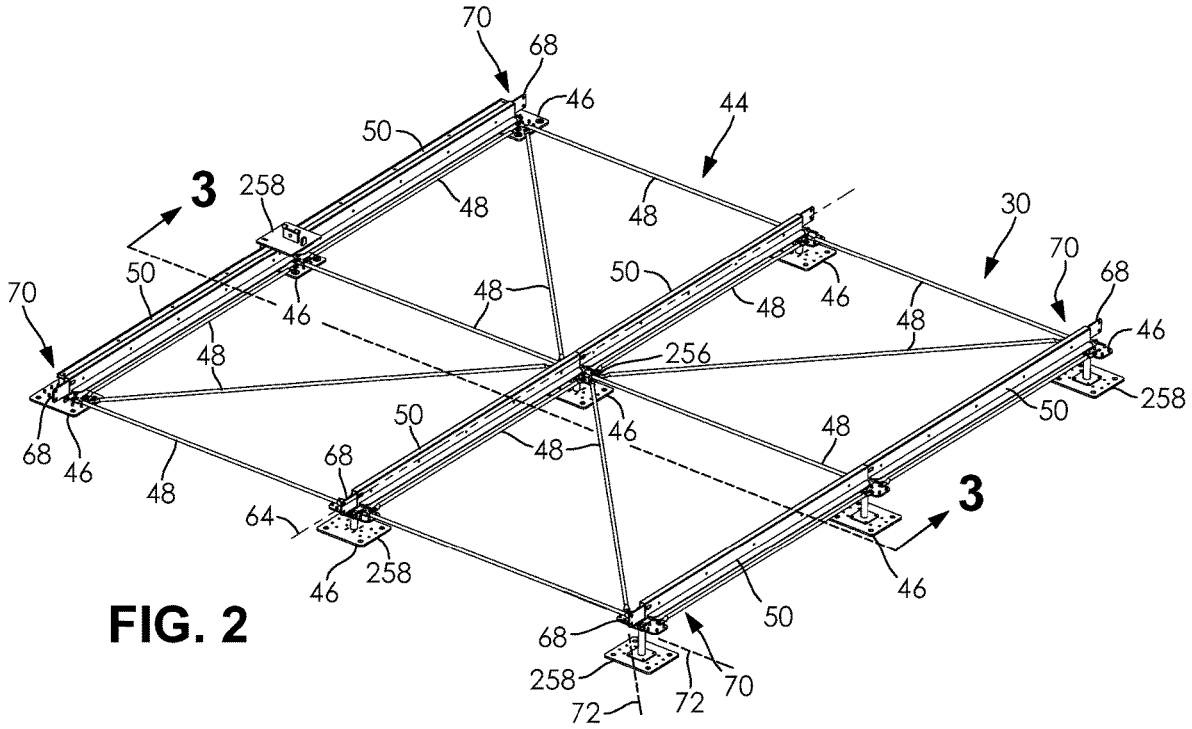
FIG. 2 is a perspective view of one embodiment of a sub-assembly of the system in FIG. 1.

Turning now to FIG. 2, one embodiment of a portion of a sub-assembly 44 of the floor system 30 is depicted. The sub-assembly 44 may have at least at least two hubs 46, at least two hub connecting members 48 and at least two beams 50. In the depicted sub-assembly, 6 beams 50 and 18 hub connecting members 48 may be used in one embodiment, but different numbers of beams 50 and hub connecting members 48 are permissible, as well as locating them in other orientations.

Figure 3:
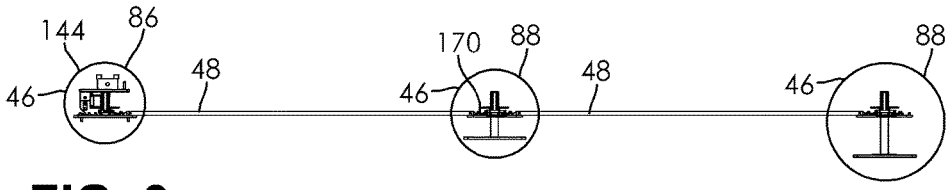
FIG. 3 is a side view of one embodiment of the sub-assembly in FIG. 2 along line 3-3.

FIGS. 2 and 3 depict 3 rows of beams 50 extending parallel one another but spaced from one another. While each row is depicted with 2 beams 50, and three rows are shown, it can be appreciated that greater or fewer beams 50 can be used with greater or fewer rows. The beams 50 may be connected together with the hub connecting members 48. The hub connecting members 48 extend between the beams 50 at angles with respect to the beams 50. The angles of the hub connecting members 48 with respect to the beams 50 may be between approximately 90 degrees and less.

The beams 50 and hub connecting members 48 may be constructed of a robust material at least capable of repeatedly being exposed to outdoor environments. Such materials may include, but are not limited to, metals including steel and alloys of aluminum, as well as composite materials, plastic, polymers and/or fiberglass.

In one embodiment, a beam 50 may be constructed of steel and it may be unitary, one-piece and integrally formed, or it may be comprised of two or more sections secured together. The beam 50 may have a number of different cross-sectional shapes including square and rectangular. In these embodiments, the beam 50 has a top surface 54, an opposite lower surface 56 and two parallel side surfaces 58, as can be appreciated from FIGS. 4 and 9. The beam 50 may have an interior portion 60, located within the top surface 54, the lower surface 56 and the side surfaces 58, that may be substantially hollow along its length.

The beam 50 may have lips 62 that may be L-shaped flanges connected to both of the side surfaces 58 of the beam 50. A first leg 62A of the L-shaped flange may be secured to a side surface 58, such as by welding or with mechanical fasteners. A second leg 62B of the L-shaped flange may extend perpendicularly away from the side surface 58, such as a right angle to a side surface 58. The L-shaped flanges may be secured to the side surfaces 58 so that the second leg 62B is at or below a centerline 64 (see FIG. 2) of the beam 50.

The L-shaped flanges may support flooring sections 66 thereon. The flooring sections 66 may be such as walking surfaces supported by metal frame works (not shown). The metal frame works may extend about a perimeter of the underside of the flooring sections 66. The metal frames are sized and shaped to fit between the beams 50 by resting on the L-shaped flanges. The flooring sections 66 may be constructed of wood, composite materials, metals including steel and alloys of aluminum and/or polymers.

The beam 50 may also have end flanges 68 extending from one or both of beam end portions 70. In one embodiment, each end portion 70 has an end flange 68 secured within the hollow interior portion 60 of the beam 50. The end flange 68 may be secured such as by welding and/or mechanical fasteners. In one embodiment, an end flange 68 at one end of the beam 50 may be secured to an opposite side surface 58 of the beam 50 compared to an end flange 68 at the other end portion 70 of the beam 50. This permits beams 50 to be connected to one another end to end. The end flange 68 may be such as a rectangular plate with a height designed to be accommodated within the end portion 70 of a beam 50 it is affixed to, as well as an adjacent beam 50 it can be slid into. The thickness of the end flange 68 may be only a portion of the width of the interior portion 60 of the beam 50. This arrangement facilitates locating an end flange 68 into the end portion 70 of another adjacent beam 50 that also has an end flange 68. The length of the end flange 68 may be a small fraction of the length of the beam 50.

In one embodiment, the hub connecting members 48 may be a rod, such as depicted in FIG. 2. Each rod may be constructed of steel and may be unitary, one-piece and integrally formed. Each rod may extend substantially along a single longitudinal axis 72.

Figure 9:
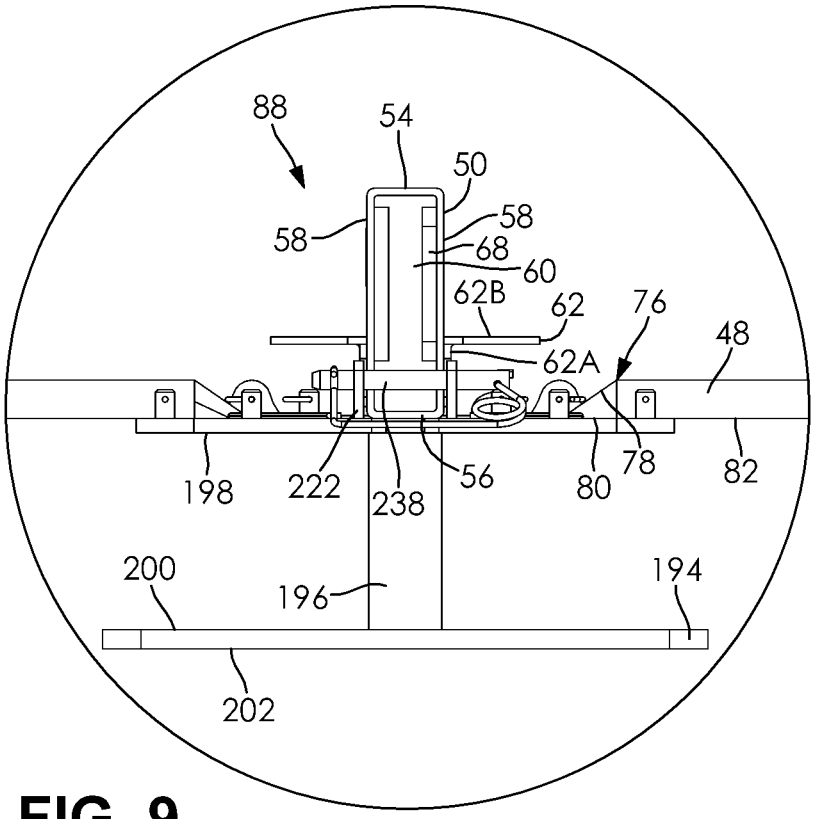
FIG. 9 is a side view of one embodiment of a connector hub.
Figure 11:
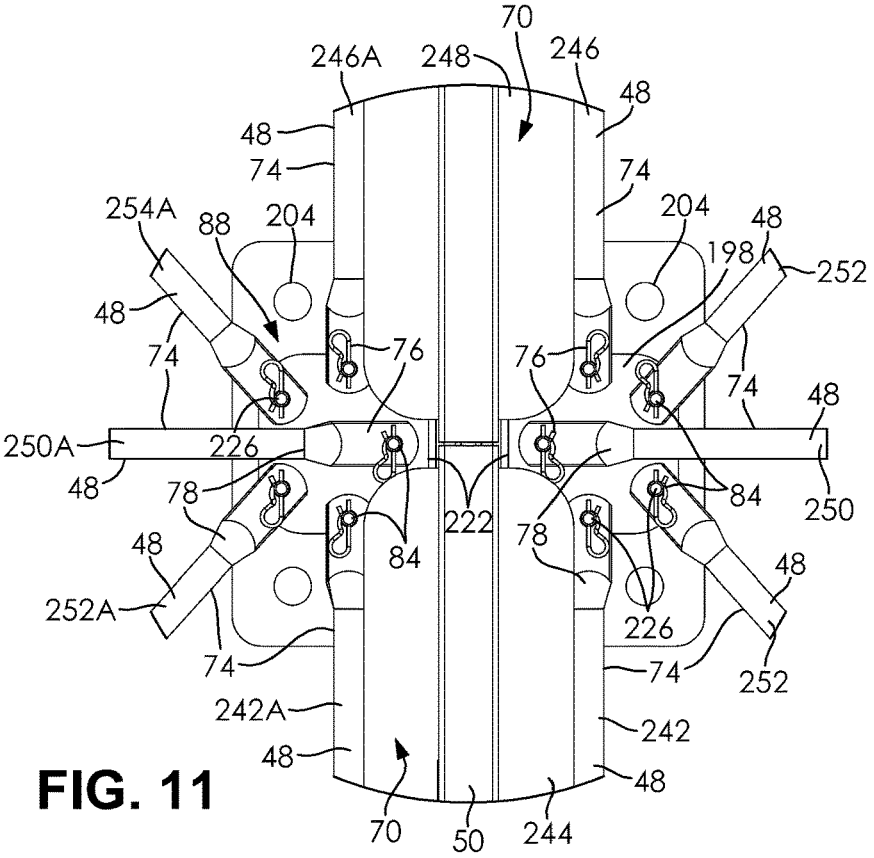
FIG. 11 is a top view of a connector hub with rods and beams located thereon.
Figure 12:
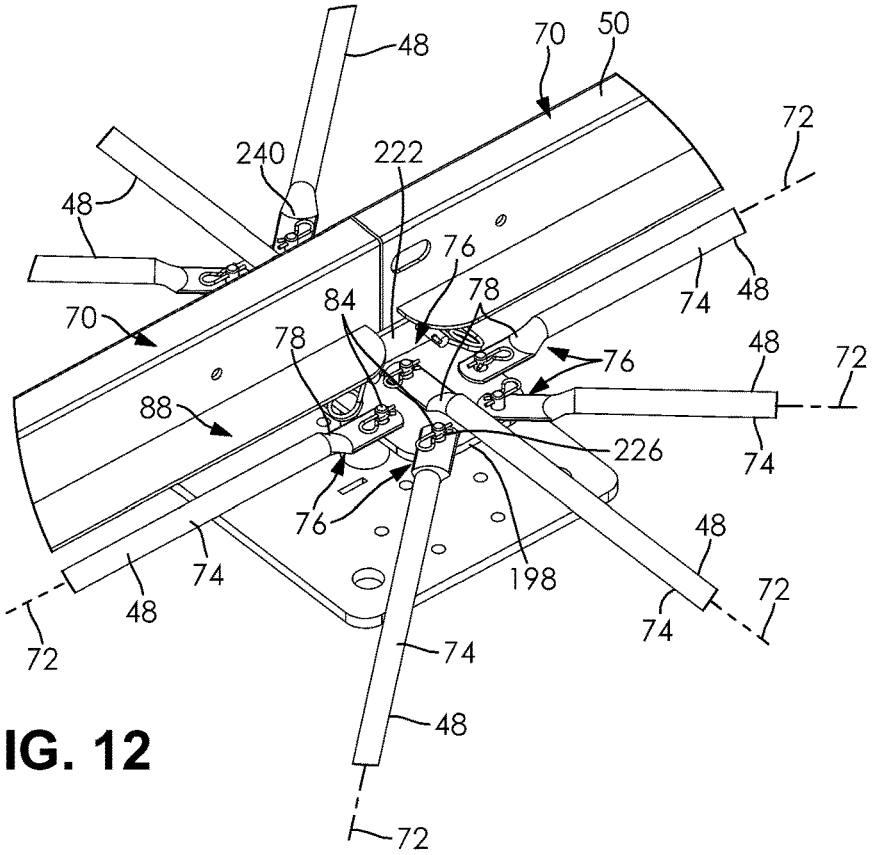
FIG. 12 is a perspective view of the connector hub with rods and beams located thereon.

Each rod may have a central body portion 74 that has a circular or square tubular cross section, such as shown in FIGS. 11 and 12. Each rod may have end portions 76 on either end of the body portion 74. Angled transitions 78 signal the end of the body portion 74 and the beginning of the end portions 76. The end portions 76 may be plate-like. In one embodiment, the end portions 76 have a lower surface 80 that is coplanar with a lower surface 82 of the body portion 74, as shown in FIG. 9. Each end portion 76 of each rod may have an aperture 84 extending therethrough, as may be appreciated from FIGS. 11 and 12.

FIGS. 1, 2 and 3 also depict one embodiment of a plurality of hubs 46. A hub 46 may be such as a gable upright connector 86 or a connector hub 88. In FIG. 1, one location for a gable upright connector 86 and multiple locations for the connector hubs 88 are depicted; other locations and numbers for each gable upright connector 86 and the connector hubs 88 are permissible.

Figure 4:
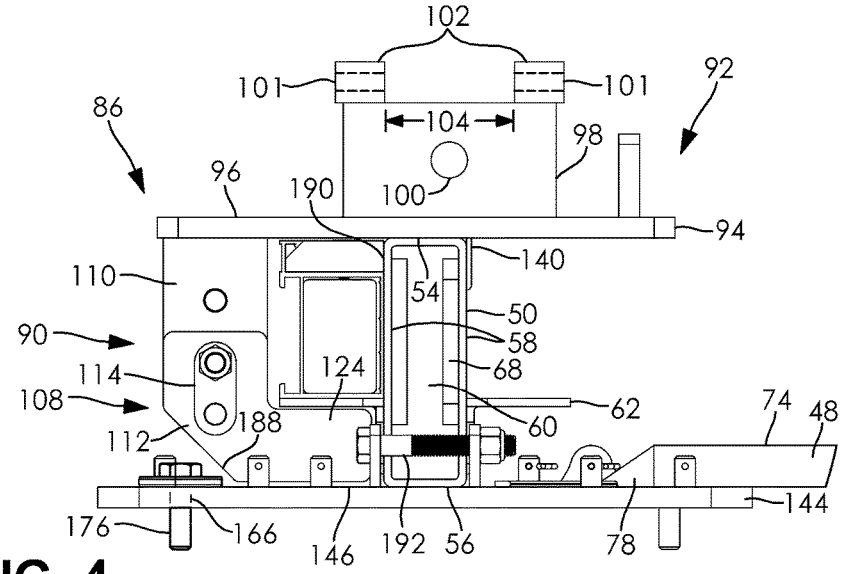
FIG. 4 is a side view of one embodiment of a gable upright connector.
Figure 5:
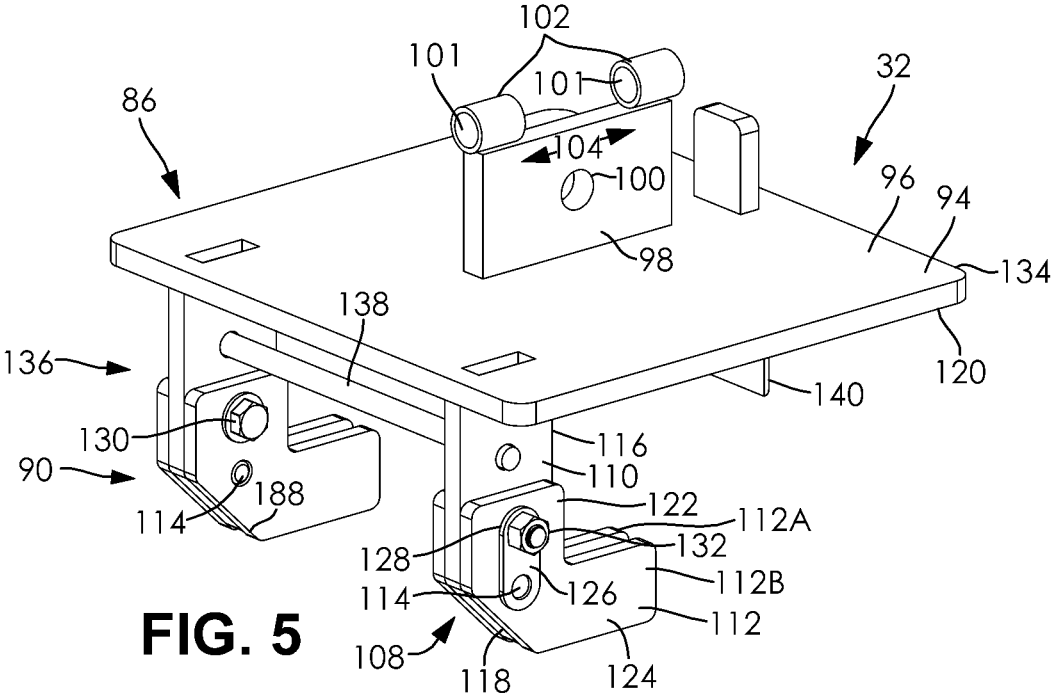
FIG. 5 is a perspective view of the gable upright connector of FIG. 4.

FIGS. 4 and 5 depict one embodiment of a gable upright connector 86. The gable upright connector 86 in these figures may have a lower portion 90 and an upper portion 92, where the two portions 90, 92 are separated from one another with a mounting plate 94. In another embodiment, the gable upright connector 86 may only be comprised of the upper portion 92 (described below) and the mounting plate 94.

In the depicted embodiment, on a top surface 96 of the mounting plate 94, an eye bolt flange 98 is secured thereto. The eye bolt flange 98 may be secured such as by welding and/or it can be located in a complementary shaped slot in the mounting plate 94. The eye bolt flange 98 may have an eye bolt aperture 100 extending therethough. The eye bolt aperture 100 may be oriented perpendicular to a primary direction of the flange 98. The eye bolt aperture 100 is adapted to receive an eye bolt (not shown), which may be used as a tie down point for other tent features.

Mounted on the eye bolt flange 98, such as on top of it, may be at least one upright pin flange 102. The upright pin flange 102 may have an upright pin aperture 101 extending through it. In the depicted embodiment, there may be two upright pin flanges 102 aligned with one another on top of the eye bolt flange 98, each having an upright pin aperture 101 therethrough. A gap 104 may separate the eye bolt flanges 98 from one another. Being aligned with one another, the apertures 100 are adapted to removably accommodate an upright pin (not shown) which selectively secures the gable upright connector 86 to an upright via a complementary shaped aperture (not shown) on the upright 34 for the pin. In the depicted embodiment, the eye bolt aperture 100 may extend perpendicularly to the upright pin aperture 101.

While one embodiment of an upper portion of a gable upright connector 86 is described and depicted, other embodiments are permissible because different tent manufacturers use different types of uprights 34. Typically, the manufacturers of the floor system 30 adapt the gable upright connector upper portions 92 to the upright 34 used by the tent manufacturer.

The lower portion 90 of the gable upright connector 86, or the portion below the mounting plate 94, may have at least a first jaw 108. The first jaw 108 may be formed by first and second legs 110, 112 that are connected together by at least one pin 114. The first leg 110 may be secured to the mounting plate 94, such as by welding, mechanical fasteners or male/female couplings.

The first leg 110 may have an attachment portion 116 and an extension portion 118. The attachment portion 116 may be connected to the mounting plate 94, as described above. The attachment portion 116 may extend downwardly from a lower surface 120 of the mounting plate 94, such as perpendicularly to the lower surface 120.

The extension portion 118 may extend at an angle to the attachment portion 116. In one embodiment, the extension portion 118 may extend so that a portion of it may be parallel the lower surface 120 of the mounting plate 94. The attachment portion 116 and the extension portion 118 of the first leg 110 may form an L-shape.

The second leg 112 may be comprised of two similarly, or identically, shaped members 112A, 112B. Members 112A, 112B may be located on each side, respectively, of the first leg 110 to sandwich the first leg 110 between members 112A, 112B. In one embodiment, the extension portion 118 of the first leg 110 is sandwiched between the extension portions 124 of the second leg 112A, 112B.

Further, each second leg 112 may be similarly, or identically, shaped to at least a portion of the first leg 110. More particularly, the second leg 112 may have a similar, or identical, shape at least to the extension portion 118 of the first leg 110, and preferably also a portion of the attachment portion 116 of the first leg 110.

In one embodiment, each second leg 112 may have an attachment portion 122 and an extension portion 124. The attachment portions 122 may connect the first leg 110 and the second leg 112 together, such as through the above-mentioned pin 114.

The pin 114 may be attached to a plate 126. The pin 114 extends through aligned apertures in each second leg 112 as well as the first leg 110.

An aperture 128 may be located in the plate 126. A mechanical fastener 130, such as a bolt may extend through the aperture 128 in the plate 126, as well as through the aligned apertures in the first and second legs 110, 112. A nut 132 may be located on the end of the fastener 130. The fastener 130, nut 132 and pin 126 may lock the legs 110, 112 of the first jaw 108 together and prevent them from moving.

The extension portions 118, 124 of both the first and second legs 110, 112 may extend toward a leading edge 134 of the mounting plate 94. The extension portions 118, 124 of both legs 110, 112 may be parallel one another. Together, the first and second legs 110, 112 may form an L-shape.

In one embodiment, there may be a second jaw 136 extending from the lower surface 120 of the mounting plate 94. A spanner 138 may extend between the two jaws 108, 136 to maintain a constant distance between them, and stabilize the jaws 108, 136 as well. The spanner 138 may be such as a metal bar, or tube, hollow or solid and of any size or shape.

While the above discusses first and second legs 110, 112 comprised of multiple pieces, it is within the scope of the design to make each leg 110, 112 a single unitary piece. Thus, the legs 110, 112 can be one piece and/or the legs 110, 112 can be one piece with the gable upright connector 86.

A stop plate 140 may extend from the lower surface 120 of the mounting plate 94. The stop plate 140 may extend downwardly from the lower surface 120 in a perpendicular fashion. The stop plate 140 may assist in fixing the position of the gable upright connector 86 against a beam 50.

Figure 6:
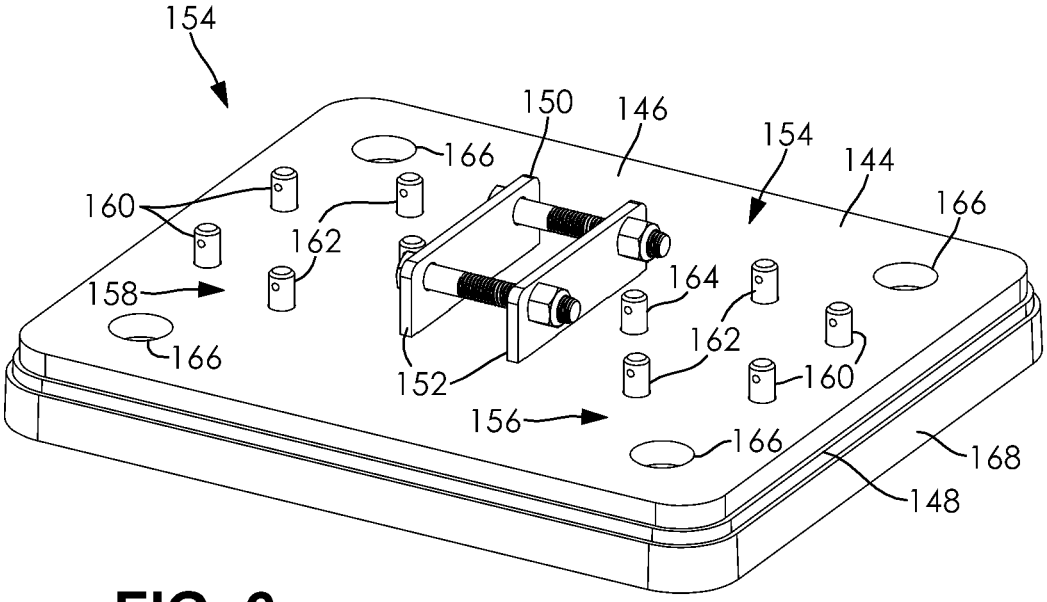
FIG. 6 is a perspective view of one embodiment of a ground saddle plate and sill.

In some embodiments, the gable upright connector 86 may be located on a ground saddle plate 144 as shown in FIG. 4. One embodiment of the ground saddle plate 144 is depicted in FIG. 6. The second legs 112 of the gable upright connector 86 may be located on, or attached to, an upper surface 146 of the ground saddle plate 144.

The ground saddle plate 144 may be a rectangular or square shaped plate with the above-mentioned upper surface 146 and an opposite lower surface 148. The two surfaces 146, 148 may define a substantially constant thickness between them.

The ground saddle plate 144 may have a beam connector attached to the upper surface 146. The beam connector may be such as a ground saddle 150. The ground saddle 150 may be comprised of two rectangular, or square, plates 152 extending perpendicularly from the upper surface 146. The two plates 152 may be parallel one another and be located a constant distance from one another on the upper surface 146.

The upper surface 146 may also have a plurality of pins 154 extending therefrom. The plurality of pins 154 may be arranged in a first group 156 and second group 158 on the upper surface 146, with the two groups 156, 158 generally divided by the ground saddle 150. In one embodiment, each of the pin groups 156, 158 may be arranged to have two leading pins 160, two middle pins 162 and a single rear pin 164 where the pins of one group 156 or 158 are aligned with respective pins in the other group 156 or 158. The pins 154 may have circular cross sections (with or without threads) and they may be all equal height above the upper surface 146. Each group of pins 156, 158 may extend, equally spaced from one another, about the upper surface 146 in a circle or a circular pattern.

The ground saddle plate 144 may also have stake apertures 166 extending therethrough. The stake apertures 166 may be located at the four corner portions of the plate but other locations and numbers may be possible. The stake apertures 166 may be located outside of each of the pin groups 156, 158.

FIG. 6 depicts a ground saddle plate 144 resting on a sill 168. The sill 168 may have a complementary shape and/or side to the ground saddle plate 144. More than one sill 168 may be located under a ground saddle plate 144 to locate the ground saddle plate 144, and thus the structure located thereon, at a particular elevation. In other words, one or more sills 168 may be located on the ground and the ground saddle plate 144 located thereon to achieve a predetermined height for the mounting plate 94 and the gable upright connector 86.

The function for a sill 168 can be appreciated from FIG. 3 where a hub connecting member 48 extends from a saddle plate 170 of a hub 46 to a ground saddle plate 144 of a gable upright connector 86. The two saddle plates 144, 170 are at the same elevation as one another, and thus the hub connecting member 48 extends substantially horizontally between the two, because sills 168 can be located beneath the ground saddle plate 144 of the gable upright connector 86 to ensure its ground saddle plate 144 is at the same elevation as the saddle plate 170 of the hub 46. It is also permissible to use any number of sills 168 under any of the gable upright connectors 86, or hubs 46, of the sub-assembly 44 to provide them with any need elevation for a particular application. From the above, it can be appreciated that ground elevation changes can be accommodated by the sub-assembly 44 to provide a flat and even floor surface over most any terrain.

Figure 7:
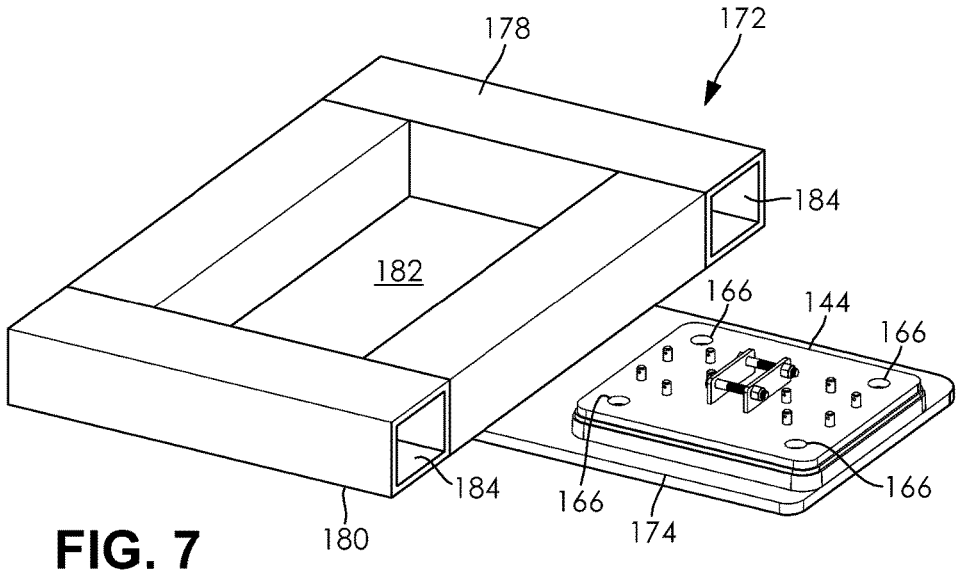
FIG. 7 is a perspective view of one embodiment of a ballast weldment with a saddle plate.

FIG. 7 depicts one embodiment of a ground saddle plate 144 (which could also be addle plate 170) on a ballast structure 172. The ballast structure 172 may be comprised of a ballast plate 174 on which the ground saddle plate 144 may be mounted. The ballast plate 174 may have a complementary shape to the ground saddle plate 144 and have stake apertures (not shown) in locations complementary to stake apertures 166 in the ground saddle plate 144. In some embodiments, mechanical fasteners (not shown), such as bolts, may extend through threaded apertures (not shown) into the ballast plate 174 to secure the ballast plate 174 and the ground saddle plate 144 together.

The ballast structure 172 may also comprise a ballast frame 178. The ballast frame 178 may be connected to the ballast plate 174 such as by welding and/or mechanical fasteners. Friction pads, or additional frame components (not shown), may be added to the ballast frame 178 to increase its resistance to lateral forces. Friction pads may be attached by chemical bond or mechanical fasteners to a lower surface 180 of the ballast frame 178 in any shape or location and may consist of metal, metal with wood inlay, rubber, plastic, polymer, etc.

As shown in FIG. 7, the ballast frame 178 may be such as square or rectangular. While FIG. 7 depicts the ballast frame 178 as being made of members defining a perimeter with an open center portions 182, the ballast frame 178 may be comprised of a single piece, and/or the center portion 182 may be closed, partially closed and contain additional components.

It may be preferred that the ballast frame 178 has at least two forklift tine receiving members 184, such as tubes with open ends. This enables a forklift to engage the ballast structure 172 and move it to the desired position. Alternatively, the ballast frame 178 may be closed ended at one or more ends.

The ballast frame 178 may be designed to receive one more ballast weights (not shown) thereon. The ballast weight may be heavy items comprising many thousands of pounds. The ballast weights provide a large downward force on the frame 178 to anchor the frame 178, and the structures attached to it, or on it, to prevent them from moving unexpectedly. The ballast structure 172 may replace the need to drive stakes into the ground to secure the tent structure 32 to the ground. The ballast structure 172 may also reduce the number of stakes that may be needed compared with prior art designs. The ballast structure 172 thus advantageously prevents or reduces damage to the ground with stakes or the like.

Figure 8:
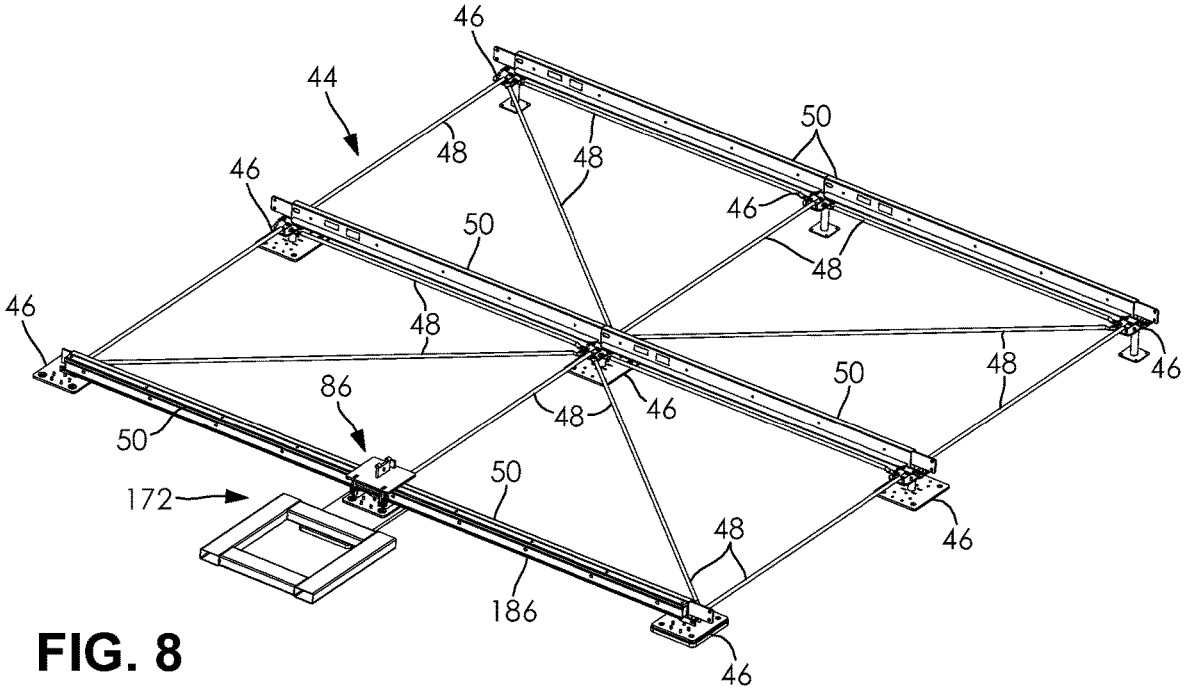
FIG. 8 is a perspective view of one embodiment of a sub-assembly with a ballast structure.

FIG. 8 depicts one embodiment of a ballast structure 172, a gable upright connector 86 and a sub-assembly 44 of the floor system 30. The ballast structure 172 and gable upright connector 86 are positioned at one location at the sub-assembly 44. It can be appreciated that the ballast structure 172 may be located outside a perimeter 186 of the sub-assembly 44 and may not be designed to be covered by the tent structure 32 (appreciated from FIG. 1), which may maximize floor space within the tent structure 32.

The ballast structure 172 may be used with a gable upright connector 86, as shown in FIG. 8, or the ballast structure 172 may be used with a hub 46. Further, the ballast structure 172 may be located anywhere about the perimeter 186 of the sub-assembly 44 and any number of the ballast structures 172 may be used.

Turning back to FIGS. 4 and 5, it can be appreciated that the first and second legs 110, 112 of the gable upright connector 86 are shaped so as to provide access to the stake apertures 166 in the ground saddle plate 144. The angled nature of the first and second legs 110, 112, at a transition 188 from the attachment portion 116, 122 to the extension portion 118 124, adjusts the position of the legs 110, 112 so that they do not block the stake apertures 166. This permits ground stakes, if needed, to be driven through the stake apertures 166 and into the ground, or for fasteners 176 securing the ground saddle plate 144 to the ballast plate 174 to be easily accessed. This permits the ground saddle plate 144 to be secured on all four corners to the ground, a sill 168 or a ballast plate 174, resulting in a robust connection. As noted above, however, the use of stakes becomes optional.

From FIG. 4 it can be appreciated that the jaws 108, 136, the stop plate 140, the lower surface 120 of the mounting plate 94, the ground saddle 150 and/or the ground saddle plate 144 may form a receptacle 190 for the beam 50. In some cases, the top surface 54 of the beam 50 may be in direct contact with the lower surface 120 of the mounting plate 94. Further, a side surface 58 of the beam 50 may be in direct contact with the stop plate 140. Further, the lower surface 56 of the beam 50 may be located on the upper surface 146 of the ground saddle plate 150. Further yet, the extension portions 124 of the second legs 112 may be located in direct contact with a side surface 58 of the beam 50. Thus, the receptacle 190 may have a complimentary shape to the cross-sectional shape of the beam 50. In some embodiments, a fastener 192 may extend through the ground saddle 150 and both side surfaces 58 of the beam 50 to lock them together. FIG. 4 also depicts one embodiment where the ballast structure 172 may be located opposite from the plurality of pins 154 on the ground saddle plate 144.

Further, while the above has described the jaw(s) 108, 136 used with the eye bolt flange 98, the upright pin flange 102 and the stop plate 140, it is permissible to separate the two and to use the jaw(s) 108, 136, the ground saddle 150 and the ground saddle plate 144 independently of the stop plate 140 and flanges 98, 102. By separating these structures, the flanges 98, 102 can be located where uprights 34 are needed and the jaw(s) 108, 136 can be located anywhere along a beam 50. This is advantageous so that ballast structures 172 can be added in any number and/or location regardless of the location of an upright 34, or a ground saddle 150.

In one embodiment, a ballast structure 172 may secure a ground saddle plate 144 (such as via the jaws 108, 136), which in turn secures a beam 50. And, the beam 50 may secure the hubs 46, and the structures connected to them.

Figure 10:
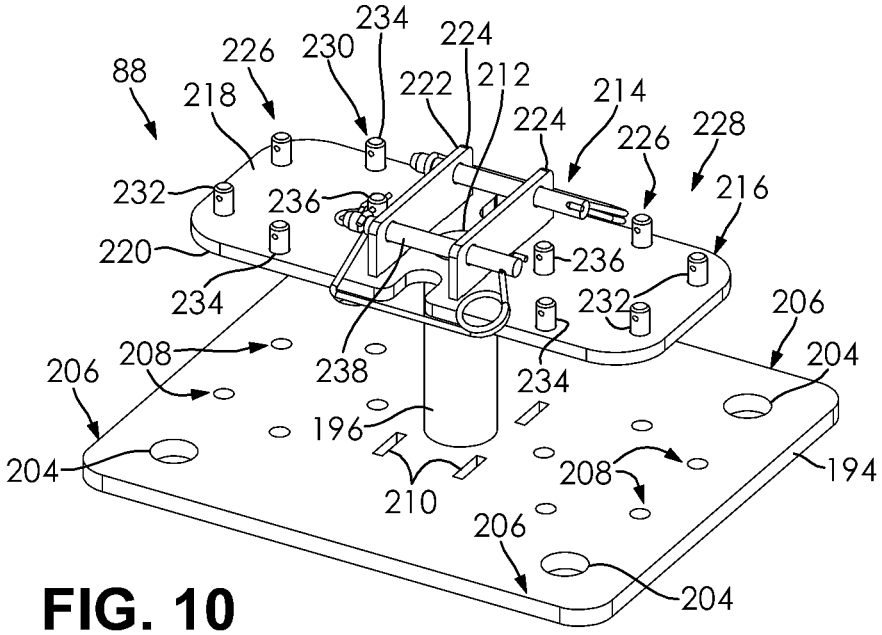
FIG. 10 is a perspective view of a footer plate, a riser and a saddle plate for the connector hub.

Turning now to FIGS. 3, 9 and 10, one embodiment of a connector hub 88 is depicted. The connector hub 88 may have a footer plate 194, a riser 196 and a saddle plate 198 (which may be such as a saddle plate 170). The footer plate 194 may be a rectangular or square shaped plate with an upper surface 200 and an opposite lower surface 202. The two surfaces 200, 202 may define a substantially constant thickness between them. The footer plate 194 may also have stake apertures 204 located in corner portions 206 of the footer plate 194. The footer plate 194 may be essentially the same as the ground saddle plate 144 for the gable upright connector 86, minus the ground saddle 150 and the plurality of pins 154. The footer plate 194 may, however, have apertures 208 to receive plurality of pins (not shown) as well as slots 210 for the ground saddle (not shown). This permits the same plate to be used for the connector hub footer plate 194 and the ground saddle plate 144.

The riser 196 may extend from a riser aperture 212 in a central portion 214 of the plate 194. The riser 196 may be such as a tubular column, but other shapes are permissible. The riser 196 supports the saddle plate 198 above the footer plate 194. In one embodiment, there may be no other structures that support the saddle plate 198 above the footer plate 194 other than the single riser 196. In this embodiment, side portions 216 may be cantilevered from the riser 196 over the footer plate 194. The riser 196 may have different heights which can be appreciated from FIGS. 1 and 2.

The saddle plate 198 may be a rectangular or square shaped plate with an upper surface 218 and an opposite lower surface 220 defining a substantially constant thickness between them. The saddle plate 198 may be a smaller rectangle or square compared with the footer plate 194. Preferably, the saddle plate 198 does not overlap the stake apertures 206 in the footer plate 194 so that the stake apertures 204 are accessible if needed.

The saddle plate 198 may have a beam connector attached to the upper surface 218. The beam connector may be such as a saddle 222. The saddle 222 may be comprised of two rectangular or square plates 224 extending perpendicularly from the upper surface 218. The two plates 224 may be parallel one another and be located a constant distance from one another on the upper surface 218.

The upper surface 218 may also have a plurality of pins 226 extending therefrom. The plurality of pins 226 may be arranged in a first group 228 and second group 230 on the upper surface 218, with the two groups 228, 230 generally divided by the saddle 222. In one embodiment, each of the pin groups 228, 230 are arranged to have two leading pins 232, two middle pins 234 and a single rear pin 236. The pins 226 in each group 228, 230 may be equally spaced from one another about an imaginary circle. The two leading pins 232 of each pin groups 228, 230 may be aligned with one another, the two middle pins 234 in each of the pin groups 228, 230 may be aligned with one another and the single rear pins 234 in the pin groups 228, 230 may be aligned with one another. The pins 226 may have circular cross sections and they may be all equal height above the upper surface 218.

Some pins 226 may have entirely smooth outer surfaces, the outer surfaces may be threaded, or some pins 226 may have combinations of smooth and threaded outer surfaces.

As may be appreciated in at least FIGS. 11 and 12, beam 50 may be attached to the saddle plate 198 by locating the side surfaces 58 of the beam 50 within the saddle 222. Thus, the lower surface 56 of the beam 50 may be in direct connect with the upper surface 218 of the saddle plate 198 and at least portions of the side surfaces 58 of the beam 50 may be in direct contact with the saddle plates 222. Pins or fasteners 238 (best seen in FIGS. 9 and 10) may extend through aligned apertures (not shown) in the side surfaces 58 of the beam 50 and the saddle 222 to secure them together.

Turning now to FIGS. 2, 3, 11 and/or 12, two beam end portions 70 are depicted as meeting on the saddle plate 224 of a connector hub 88. The figures also depict one embodiment for connecting the hub connecting members 48 with connector hubs 88. While one number of hub connecting members 48 are depicted in one orientation, other members and orientations may be used. In the depicted embodiment, ten hub connecting members 48 connect with as many pins 226 (appreciated from FIG. 10) on connector hubs 88. In one embodiment, the end aperture 84 on the end portion 76 of each hub connecting members 48 may receive at least one of the pins 226. In the figures, each hub connecting member 48 may connect with a single pin 226, however, it is possible to add more pins for each hub connecting member 48 (with associated apertures in the hub connecting member 48). The hub connecting member 48 may be secured to the pins 226 with mechanical fasteners, such as cotter pins 240 (seen in FIG. 12). In another embodiment, the pins 226 may be threaded and nuts may be located over the hub connecting member 48 and the pins 226 to secure them together.

As best seen in FIG. 11 (and appreciated from FIGS. 10 and 11), where the hub connecting members 48 are rods, a first rod 242 may extend substantially parallel along a first beam 244. The first rod 242 receives a first pin (one of the middle pins 234) on the saddle plate 224 in an aperture 84 on the rod 242. A second rod 246 may extend substantially parallel along a second beam 248 that is located on the same saddle 222 as the first beam 244. The second rod 246 receives a second pin (one of the middle pins 234) on the saddle plate 224 in an aperture 84 on the rod 242. A third rod 250 may extend substantially perpendicularly to the first and second beams 244, 248 in the saddle 222. The third rod 250 may be aligned with an intersection of the first and second beams 244, 248 in the saddle 222. The third rod 250 may be located between the first and second rods 242, 246 on the saddle plate 224. The third rod 250 receives a third pin (the rear pin 236) on the saddle plate 224 in an aperture 84 on the rod 250. A fourth rod 252 may be located between the first and third rods 242, 246; it may be located at about a 45 degree angle to the first beam 244. The fourth rod 252 receives a fourth pin (one of the leading pins 232) on the saddle plate 224 in an aperture 84 on the rod 252. A fifth rod 254 may be located between the second and third rods 246, 250; it may be located at about a 45 degree angle from the second beam 248. The fifth rod 254 receives a fifth pin (one of the leading pins 232) on the saddle plate 224 in an aperture 84 on the rod 254. Preferably, none of the rods 242, 246, 250, 252, 254 extend over the stake apertures 204, thus leaving them exposed and accessible. In one embodiment, none of the rods 242, 246, 250, 252, 254 extend over one another.

FIG. 11 also depicts another set of five rods 242A, 246A, 250A, 252A, 254A connected with the second pin group 230 in the same or similar manner to what is described above. The arrangement depicted in FIG. 11 can be such as the middle hub in of FIG. 2. Thus, the connection system in FIG. 11 may be such as a hub 46 from which hub connecting members 48 radiate therefrom, but it is not limited to this location. If desired for clarity in describing the connector hub 88 in FIG. 11 with the others depicted in FIG. 2, the connector hub 88 in FIG. 11 can be designated a central connector hub 256 and the other hubs 46 can be designated as outlier connector hub 258, of which the gable upright connector 86 may be a part.

From FIG. 2 it can be appreciated that the hub connecting members 48 extending from the central connector hub 256 may extend to the outlier connectors hub 258, to gable upright connectors 86 and/or the hub connecting members 48 may extend to additional central connector hubs 56. In these cases, the apertures 84 on the end portions 76 of the hub connecting members 48 are located on the pins 154, 226 associated with other connector hubs 88 or other gable upright connectors 86 in the same or similar manner as described above. For these cases, it may be that only one or two hub connecting members 48 connect with one of the outlier connector hubs 256 or a gable upright connector 86. In some cases, it has been found to be sufficient to connect the central connector hub 256 and gable upright connector 86 in this way. It is also permissible for more hub connecting members 48 to extend between any of the hubs 46. The hub connecting members 48 help to secure the beams 50, and thus the floor system 30, together in a robust but lightweight and cost effective manner.

The stake apertures 166, 204 mentioned herein may receive ground stakes/spikes therein as needed. Namely, the flooring system 30 may be used with the ballast structure 172 in whole or in part, or not at all. Similarly, the ground stakes/spikes may be used in whole, in part or not at all.

From the above, it can be appreciated that the connector hubs 88 and/or the gable upright connectors 86 may define the location of the junctions/intersections between beams 50, as well as the connections between the connector hubs 88 and the beams 50.

Further, the hub connecting members 48 and pin 154, 226 combination, used to tie the connector hubs 88 and gable upright connectors 86 together, and also the beams 50, advantageously results in a square, or rectangular, foundation for the system 30. This eliminates the need to measure for square when building the system 30, which is a labor and time savings. It is advantageous for the system 30 to be square so that any tent structure 32, or other structure attached to the system 30, may attach correctly thereto.

Figure 13:
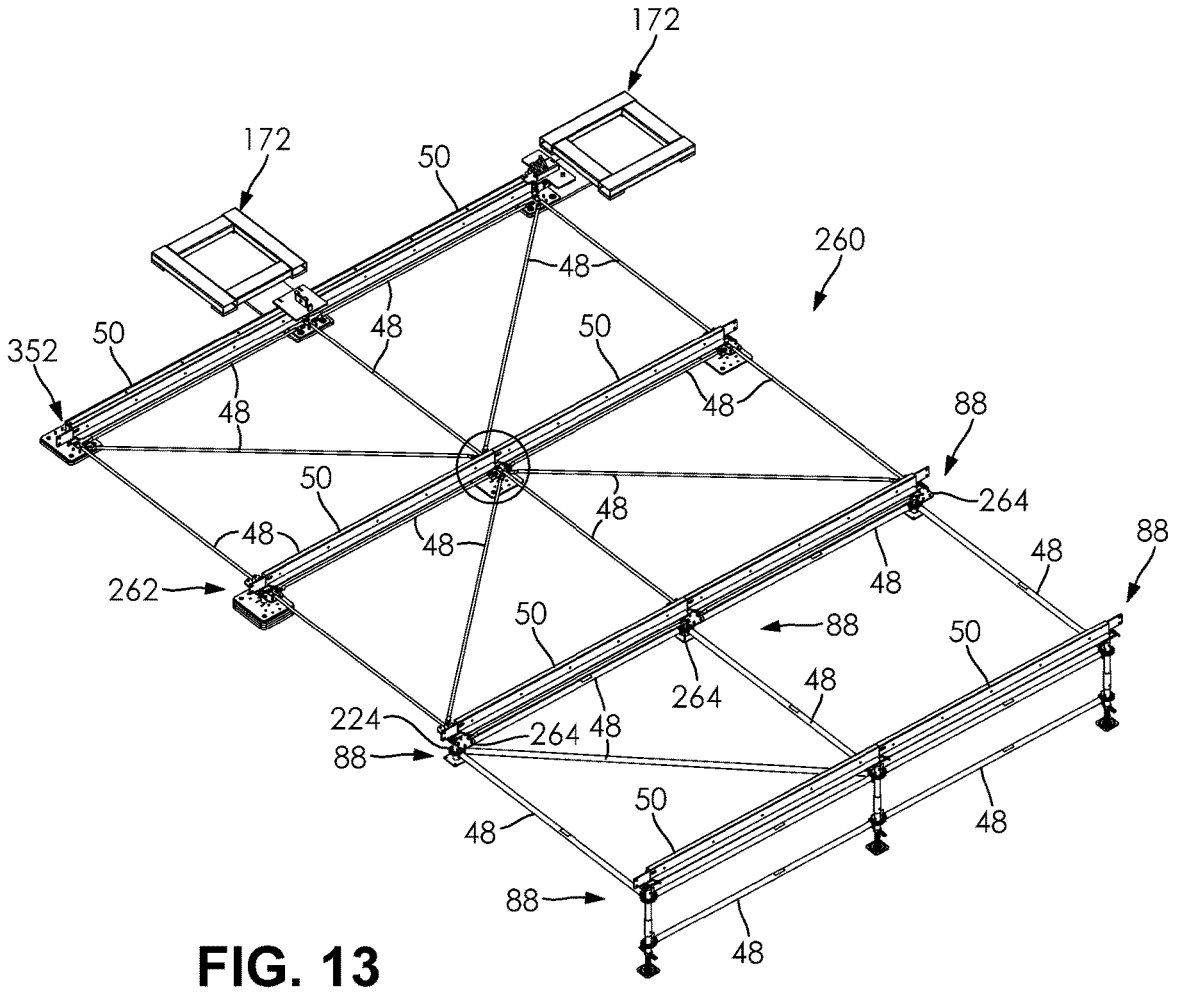
FIG. 13 is a perspective view of another embodiment of a floor system for a tent structure.
Figure 14:
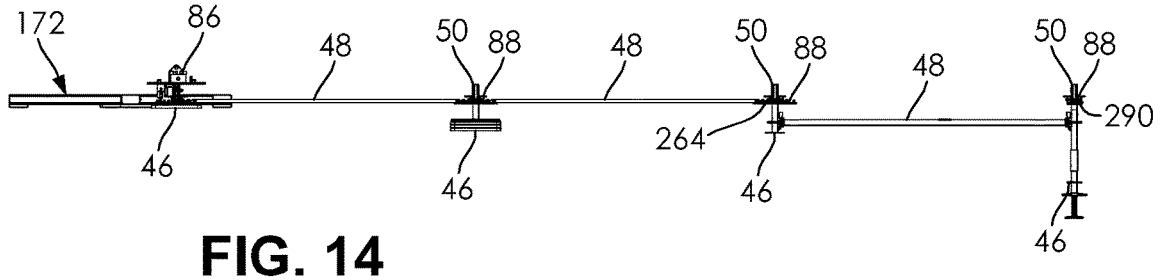
FIG. 14 is a side view of the embodiment in FIG. 13.

Turning now to FIGS. 13 and 14, another embodiment of a sub-assembly 260 for a floor system 262 is depicted. From FIGS. 1-12, it can be appreciated that the embodiment depicted in FIGS. 13 and 14 adds additional structure to FIGS. 1-12, and shows how the structure in FIGS. 1-12 can be modified or adapted to different configurations. The embodiment in FIGS. 13-14 is equally adapted for use with at least clear span tent structures, frame tent structures, as well as other structures.

In FIG. 13, it can been seen that additional beams 50 are added, as well as a number of hub connecting members 48. Structures in addition to the beams 50 and hub connecting members 48 are also added and these will be described below. While one embodiment of the sub-assembly 260 is depicted in FIGS. 13 and 14, others of different sizes, shapes and orientations, including different numbers and orientations of beams 50 and hub connecting members 48, are permissible.

From FIG. 13, it can be seen that in this embodiment, additional sets of beams 50 may be provided in lines that may be parallel with the other beams 50. The beams 50 in a particular line may be connected to one another in the manner described above.

The hub connecting members 48 extend between the beams 50 at angles with respect to the beams 50. The angles of the hub connecting members 48 with respect to the beams 50 may be between approximately 90 degrees and less.

The embodiment in FIGS. 13 and 14 may take all, or a portion of, the design from FIGS. 1-12 and extend it to include structures to accommodate greater height variations in the ground than the structure in FIGS. 1-12 is designed to accommodate. For example, the design in FIGS. 1-12 can be used over ground with little to no height variations. This design can be coupled with the additional structure shown in FIGS. 13-14 to accommodate adjacent ground height variations. In one embodiment, the portion of FIGS. 13-14 represented by FIGS. 1-12 can be located over ground with little to no height variation but then it can be directly coupled with the additional structure to extend the sub-assembly 260 over directly adjacent ground that is at a lower elevation. Additionally, or alternatively, the portion of FIGS. 13-14 represented by FIGS. 1-12 can be located over ground where little to no ground disturbance is desired. The portion of FIGS. 13-14 that is added to FIGS. 1-12 can be located over ground where spikes or stakes are permissible, regardless of any difference or variations in ground height.

Figure 15:
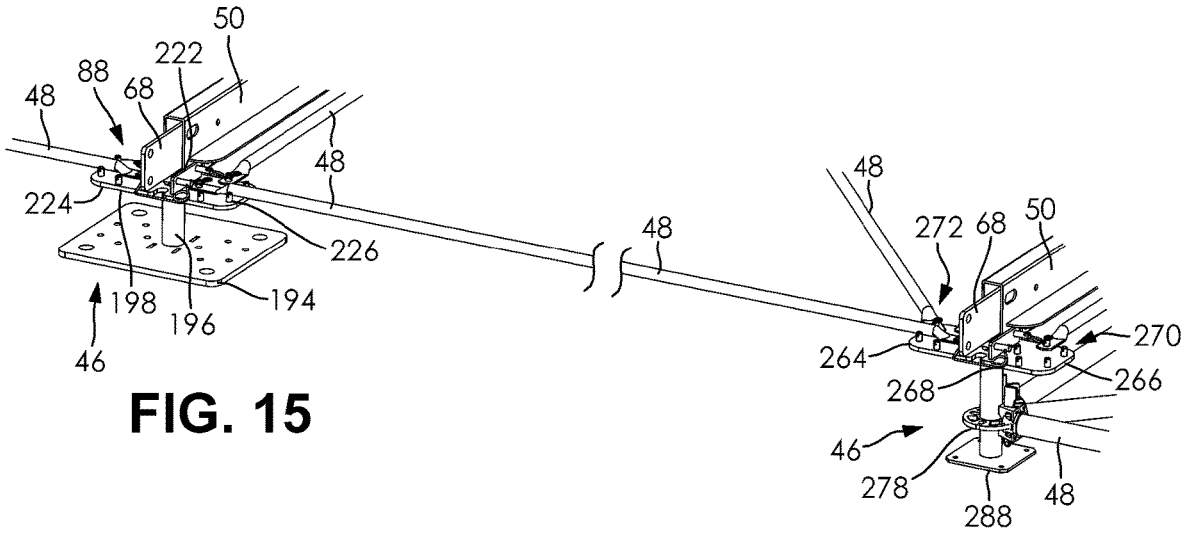
FIG. 15 is a perspective view of a portion of the floor system in FIGS. 13 and 14.

FIG. 15 depicts a portion of the sub-assembly 260 shown in FIGS. 13 and 14, such as between two hubs 46. For example, hub 46 may be a connector hub 88, as described above. One or more hub connecting members 48 may be connected to the pins 226 on the saddle plate 224 of the connector hub 88 in the same or similar manner as described above. In one embodiment, a hub connecting members 48 connected to a pin 226 on a saddle plate 224 may extend generally perpendicular to the primary direction of the adjacent beams 50. The hub connecting members 48 may extend to a beam connector. The beam connector may be such as a ring saddle 264.

While one hub connecting member 48 is mentioned above, from FIGS. 13 and 15 it can be readily appreciated that additional hub connecting members 48 may extend from the same saddle plate 224 to additional connector hubs 88, or other structures.

One embodiment of a ring saddle 264 is depicted in FIGS. 15-18. The ring saddle 264 may have a saddle plate 266. The saddle plate 266 may be the same or similar to the saddle plate 224 described above. For example, the saddle plate 266 may have a saddle 268 adapted to selectively securing a beam 50 therein, as well as two groups of pins 270, 272 separated from one another by the saddle 268. Securement of the beam 50 to the saddle 268 may be as described above, which can be appreciated in at least FIGS. 15-17.

A post 274 may extend from a bottom surface 276 of the saddle plate 266. The post 274 may have a fixed height or it may be adjustable such as through a telescopic structure. The post 274 may have a circular cross-section but other embodiments are permissible. The post 274 may be generally centered on the bottom surface 276.

In one embodiment, a ring 278 may be provide at least partially about the post 274. In one embodiment, the ring 278 may extend entirely about the post 274. The ring 278 may be located at any height of the post 274. The ring 278 may be fixed in place to the post 274 or it may be adjustable.

The ring 278 may have a plurality of apertures 280 extending through it. The apertures 280 may be located around the ring 278, or they may be in selected locations. The apertures 280 may have the same shape, share some shapes or have different shapes compared to one another.

Figure 17:
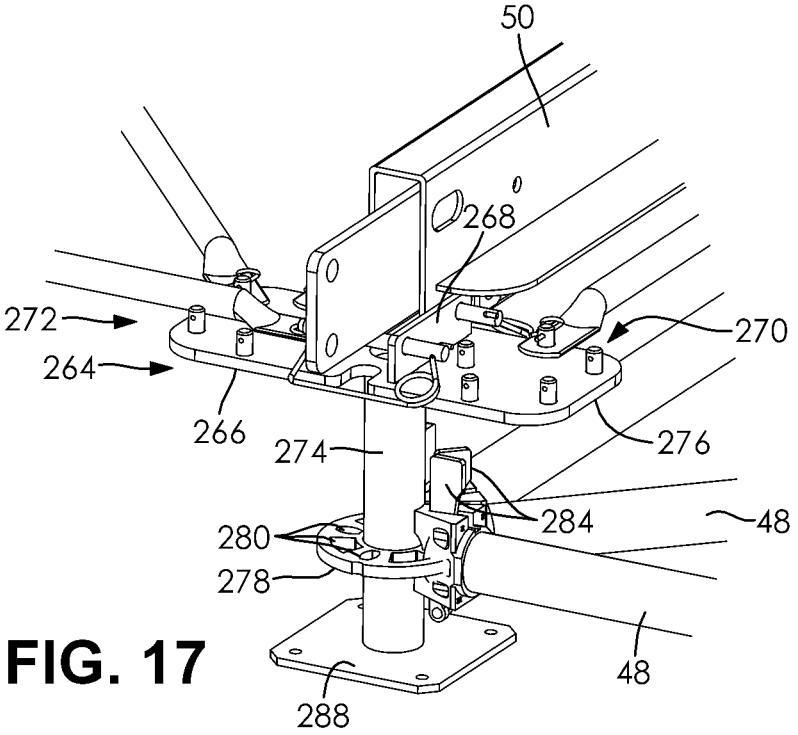
FIG. 17 is a perspective view of a portion of the floor system in FIGS. 13 and 14.
Figure 18:
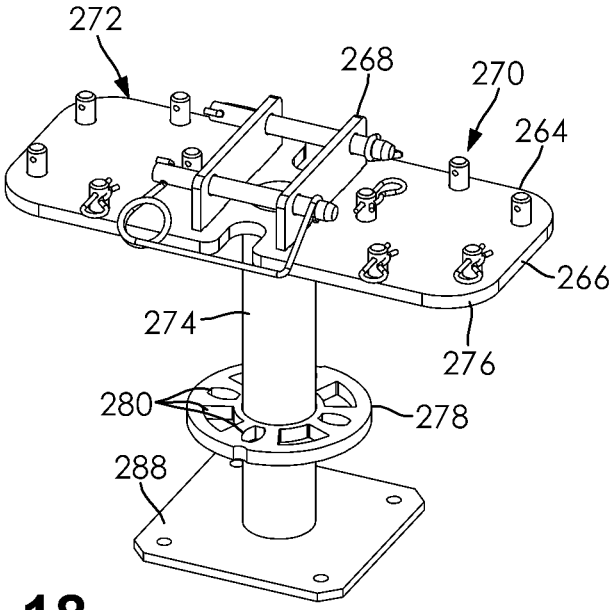
FIG. 18 is a perspective view of a portion of the floor system in FIGS. 13 and 14.

As shown in FIGS. 14, 15 and 17, hub connecting members 48, which may the same as the hub connecting members 48 discussed above, or different, may be mechanically secured to the ring 278. The hub connecting members 48 secured to the ring 278 may be different compared with the hub connecting members 48 above as they may have different structures to connect to the rings 278, however, it may be possible to provide the rings 278 with the same types of pins described above and to connect the hub connecting members 48 with the pins 282.

Figure 16:
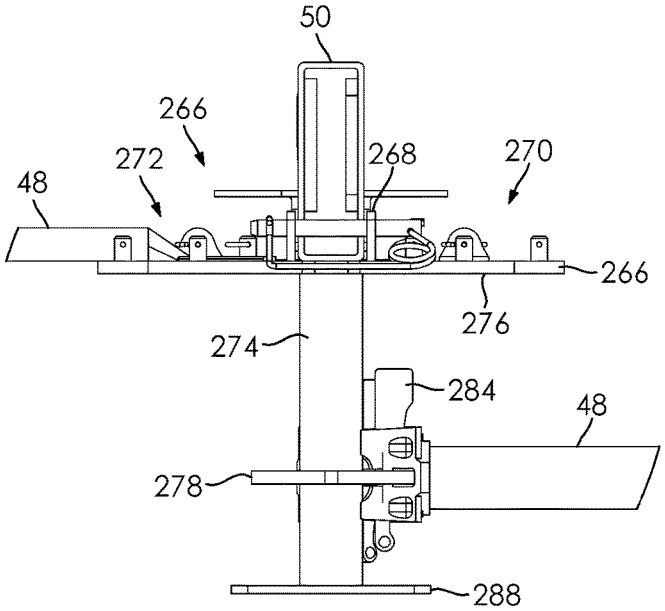
FIG. 16 is a side view of a portion of the floor system in FIGS. 13 and 14.

In one embodiment, seen in FIGS. 16 and 17, stakes 284 may be located through end connectors 286 in the hub connecting members 48, and through the apertures 280 in the rings 278, to secure the hub connecting members 48 and the rings 278 together.

A base plate 288 may be located on the post 278 opposite the saddle plate 266. The base plate 288 may rest directly on the ground, or it may be attached to any number of sills 168, in the same or similar manner described above.

As seen in FIG. 13, any number of hub connecting members 48 may extend from a saddle plate 224. The hub connecting members 48 may extend to other ring saddles 264 that have the same or similar structures, and be attached thereto, in a manner described above and depicted in the figures. Further, a beam 50 may extend from one saddle plate 264 at one hub 46 to another saddle plate 224 at another hub 46 and be connected to the saddle plates 224 as described above.

Figure 19:
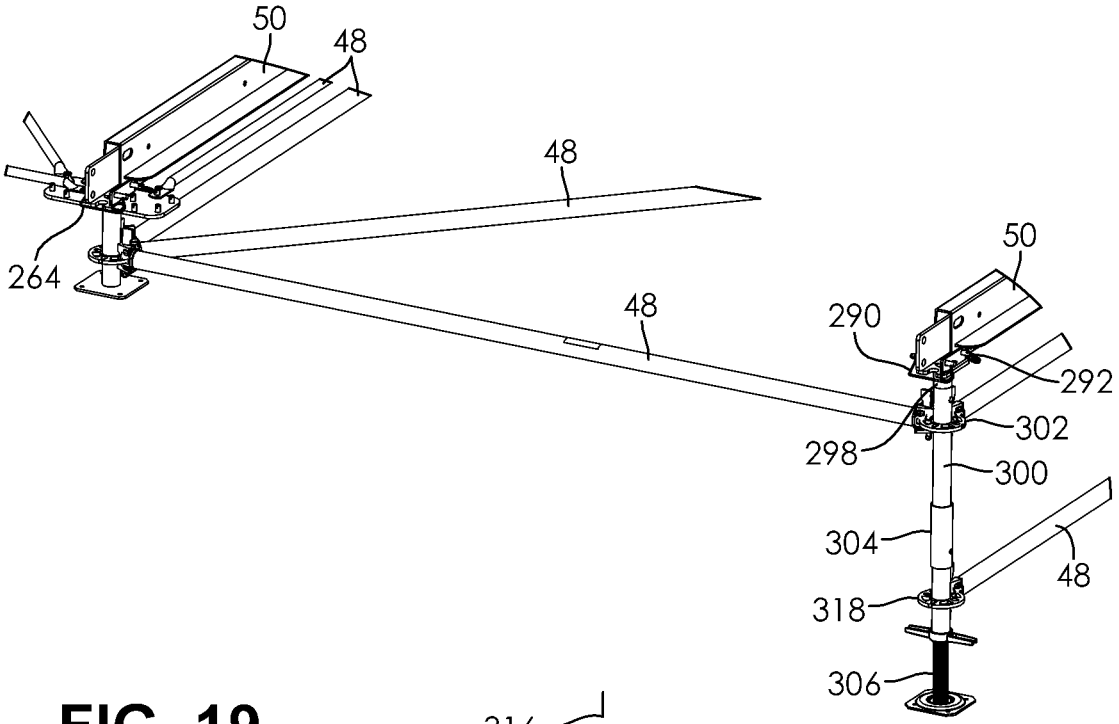
FIG. 19 is a perspective view of a portion of the floor system in FIGS. 13 and 14.

The same or similar types of hub connecting members 48 with stakes 284 and end connectors 286 may extend between hubs 46 as shown in FIGS. 14 and 19. One or more hub connecting members 48 may extend from the ring saddle 264 to a beam connector, such as an insert saddle 290. For example, one hub connecting member 48 may extend perpendicularly between beams 50 between the ring saddle 264 and the insert saddle 290.

Figure 20:
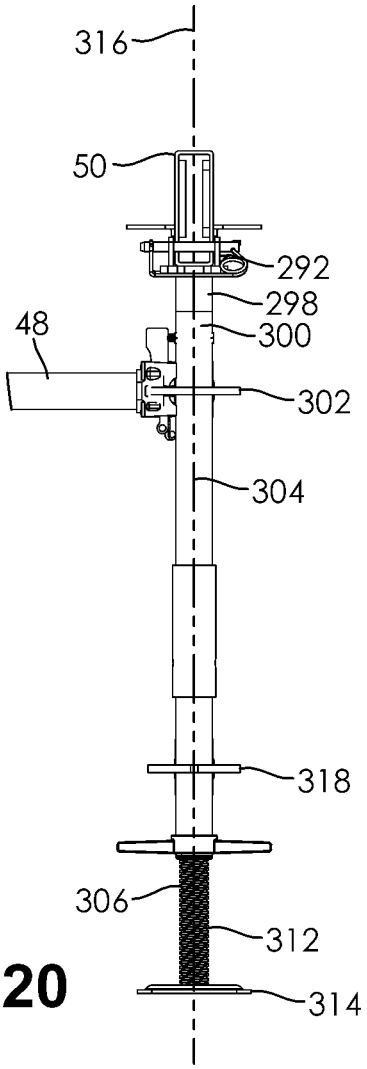
FIG. 20 is a side view of a portion of the floor system in FIGS. 13 and 14.
Figure 21:
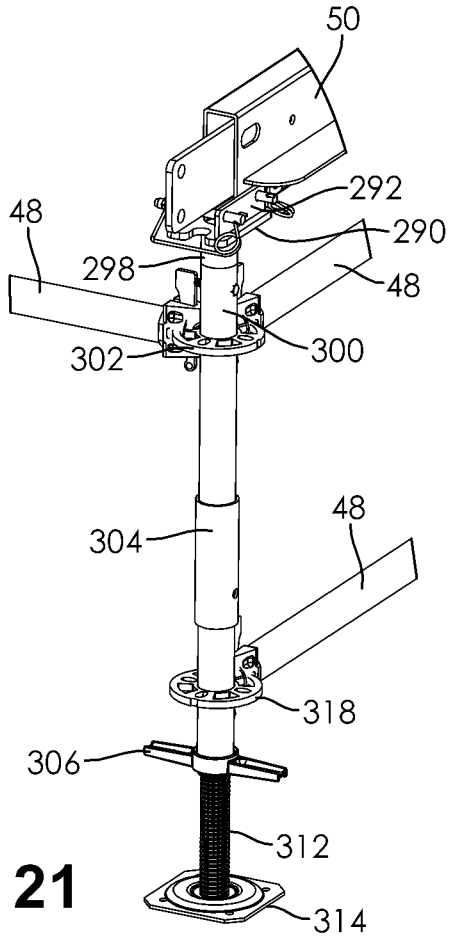
FIG. 21 is a perspective view of a portion of the floor system in FIGS. 13 and 14.

One embodiment of an insert saddle 290 is depicted in FIGS. 19-21. The insert saddle 290 may have a saddle plate 292 that are the same or similar to the plates 152, 224 described above. Namely, the saddle plates 292 may be two similarly sized end shaped plates 292 that extend parallel one another. The saddle plates 292 may be adapted to receive at least one beam 50 at least partially therein.

Extending below, such as perpendicularly, the insert saddle 290 is a tube 298. The tube 298 may be centered under the insert saddle 290. The tube may be adapted to either fit within, or fit about, a vertical 300, as best seen in FIGS. 20 and 21, however, other attachments are permissible. The tube 298 for the insert saddle 290 may be secured to the vertical 300, such as by one or more pins or fasteners (not shown). The vertical 300 may be tubular in its construction but other shapes and sizes are permissible.

In one embodiment, the vertical 300 may have an upper ring 302 extending about it. The upper ring 302 may be such as the ring 278 for the ring saddle 264 described above. The upper ring 302 may be located on the vertical 300 such that one or more hub connecting members 48 from the ring saddle 264 may be connected with it, one embodiment for which is shown in FIG. 13. From FIG. 13 it can also be appreciated that the other ring saddles 264 and upper rings 302 on other verticals 300 are preferably located in the same vertical plane as one another. By extension is it is also preferred that the saddle plates 144, 170, 198, 224, 264 are coplanar so as to result in beams 50 which are coplanar with one another.

It may be preferred that the one or more hub connecting members 48 that connect the ring saddle 264 with the upper ring 302 on the vertical 300 extend between them in a substantially horizontal orientation. In such an embodiment, the ring 278 for the ring saddle 264 and the upper ring 302 for the vertical 300 may be horizontally aligned with one another, regardless of the position of the ground beneath the rings 278, 302.

The vertical 300 may be connected to a starter 304. The starter 304 may be tubular in its construction but other shapes and sizes are permissible. The vertical 300 may be adapted to fit within one end of the starter 304, but other attachments are permissible.

The starter 304 may be connected to a jack 306. The jack 306 may have an upper tubular portion 308, but other shapes and sizes are permissible. The starter 304 may be adapted to fit about the upper tubular portion 308 of the jack 306, but other attachments are permissible. Pins or other fasteners (not shown) may be used to secure the starter 304 to the jack 306.

A lower portion 310 of the jack 306 may be comprised of a threaded leg 312. A foot 314 may be located beneath the threaded leg 312. The foot 314 may be adapted to contact the ground, or it may be located on one or more sills 168 as described above. The threaded leg 312 may be selectively threaded into and out of the jack 316 thus raising or lowering the foot 314 so that it contacts the ground or the sill 168.

While the jack 306 provides a certain degree of vertical adjustment, it can be appreciated that different lengths of verticals 300 and/or starters 304 can be used to provide additional vertical adjustment. Further, more than one vertical 300 or more than one starter 304 can be used in a line to also provide vertical adjustment.

A vertical axis 316 may extend through each saddle plate tube 298, the vertical 300, the starter 304 and the jack 306, where each of the aforementioned components are aligned along the axis 316.

A lower ring 318 may be located about the jack 306, but it may also be located about the starter 304 or the vertical 300. The lower ring 318 may be substantially the same as the upper ring 302. One or more hub connecting members 48 may extend from the lower ring 318 to other lower rings 318 and be secured with the above-mentioned stakes 284, but other embodiments are permitted.

Figure 22:
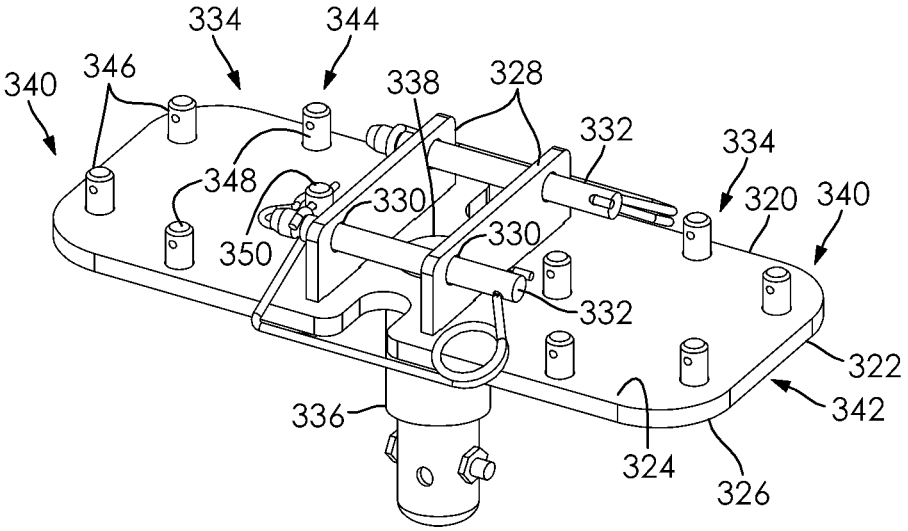
FIG. 22 is a perspective view of a portion of the floor system in FIGS. 13 and 14.

FIG. 22 depicts another embodiment of an insert saddle 320. This version of the insert saddle 320 may have saddle plate 322 with an upper and lower surfaces 324, 326. The upper and lower surfaces 324, 326 may define between them a substantially constant thickness. The saddle plate 322 may have plates 328 extending from the upper surface 324, such as generally transverse thereto. The plates 328 may be of the same or similar size and/or shape and extend parallel one another. Fastener apertures 330 may be located in the plates 328 and at least one aperture 330 in each plate 328 may be aligned with another aperture 330 in the opposite plate 328. Snap pins 332, or other fasteners, may be located in the apertures 330. From the above, it can be appreciated that the pins 332 may extend through the apertures and a beam 50 to secure the insert saddle 320 to the beam.

A tube 336 may be fitted within a tube aperture 338 in the saddle plate 322. The tube 336 may extend transversely from the lower surface 324 of the plate 322. The tube 336 and tube aperture 338 may be generally centrally located in the plate 322.

Side portions 334, which are part of the saddle plate 322, may extend away from the plates 328 so that they are they are cantilevered from the tube 336. In some embodiments, there are no other supporting structures for the side portions 334.

The upper surface 324 may also have a plurality of pins 340 extending therefrom. The plurality of pins 340 may be arranged in a first group 342 and second group 344 on the upper surface 324, with the two groups 342, 344 generally divided by the plates 328. In one embodiment, each of the pin groups 342, 344 may be arranged to have two leading pins 346, two middle pins 348 and a single rear pin 350 where the pins of one group 342, 344 are aligned with respective pins in the other group 342, 344. The pins 340 may have circular cross sections (with or without threads) and they may be all equal height above the upper surface 324. Each group of pins 342, 344 may extend, equally spaced from one another, about the upper surface 324 in a circle or a circular pattern. The pins 340 may be connected to hub connecting members 48 as noted above.

From FIG. 13 it can be appreciated that a system of beams 50 is supported by a number of ring saddles 264 and insert saddles 290, 320, as well as the structures that support the saddles 264, 290, 320. Further, a grid of hub connecting members 48 may extend between the ring saddles 264 and insert saddles 290, 320. The hub connecting members 48 function to secure the various rows of beams 50 together in a secure and stationary manner and in a particular location.

FIG. 13 also demonstrates that one more ballast structure 172 may be located about the sub-assembly 260. FIG. 13 shows two ballast structures 172 located on the first row of beams 50, however, any number of ballast structures 172 may be located anywhere about the sub-assembly 260. In some cases, the ballast structures 172 may be located at ends of beams 50 and/or where beams 50 join together. Certain embodiments may locate the ballast structures 172 at about a perimeter 352 of the sub-assembly 260 about the perimeter 352. Further, the ballast structures 172 do not have to be oriented at the same angle to the beams 50 as one another, as shown in FIG. 13. For example, in FIG. 13, one ballast structure 172 is perpendicular to the primary direction of the beams 50, while a second ballast structure 172 is located co-axial with the primary direction of the beams 50.

Figure 23:
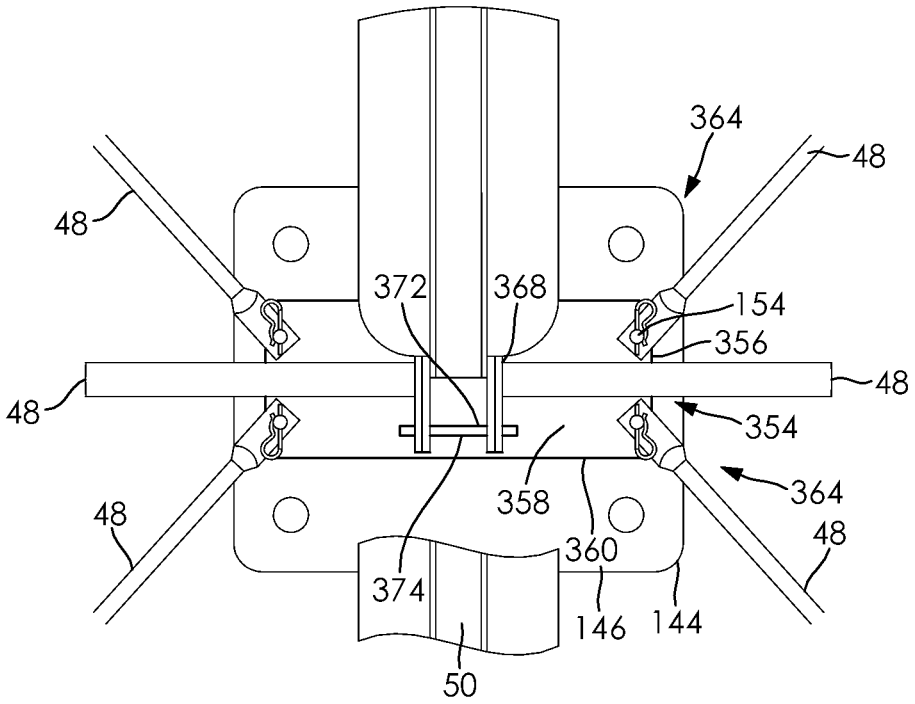
FIG. 23 is a top view of another embodiment of a portion of the system.

Turning to FIG. 23, another embodiment of an end portion 354 for the hub connecting members 48 is provided. Reference numbers for structures described above are continued in this embodiment.

In this embodiment, the hub connecting member 48 may be such as a portion of a rod. The end portion 354 of the rod may be provided with a plate 356. The plate 356 may have an upper and a lower surface 358, 360 where the two surfaces 358, 360 have planar portions which may define a substantially constant thickness between them. In some embodiments, the lower surface 360 may be in direct contact with the upper surface 146 of a ground saddle plate 144 as described above.

The plate 356 may have at least one pin aperture (not shown) extending from the upper surface 358 to the lower surface 360. In some embodiments, the plate 356 may have a pin aperture 362 in each of its outer corner portions 364. The pin apertures 362 may be aligned with the pins 154 in the ground saddle plate 144. The number and location of the pins 154 for the ground saddle plate 144 for this application may vary compared with the number and locations described above. The pin apertures 362, permit the pins 154 to extend through the plate 356. Hub connecting members 48 may connect with the pins 154 as described above.

The plate 356 may have an upstanding flange 368 that extends at least across a portion of the plate 356. The flange 368 may have at least one fastener aperture 370 extending therethrough. The at least one fastener apertures 370 may be aligned with at least one fastener apertures 372 in the plates 152 of the ground saddle 150. Fasteners 374 may extend through the respective fastener aperture 372 to secure the flange 368, and thus the plate 356, to the saddle 150.

In some embodiments, such as where the hubs connecting member 48 is a rod-like structure a portion of the rod may be secured to the upstanding flange 368 and/or the plate 356. The rod may be welded to the plate 356 and/or the flange 368, but other structures and devices may be used to connect the two together. The rod may be located between the fastener apertures 370 and/or the pin apertures 362.

Figure 24:
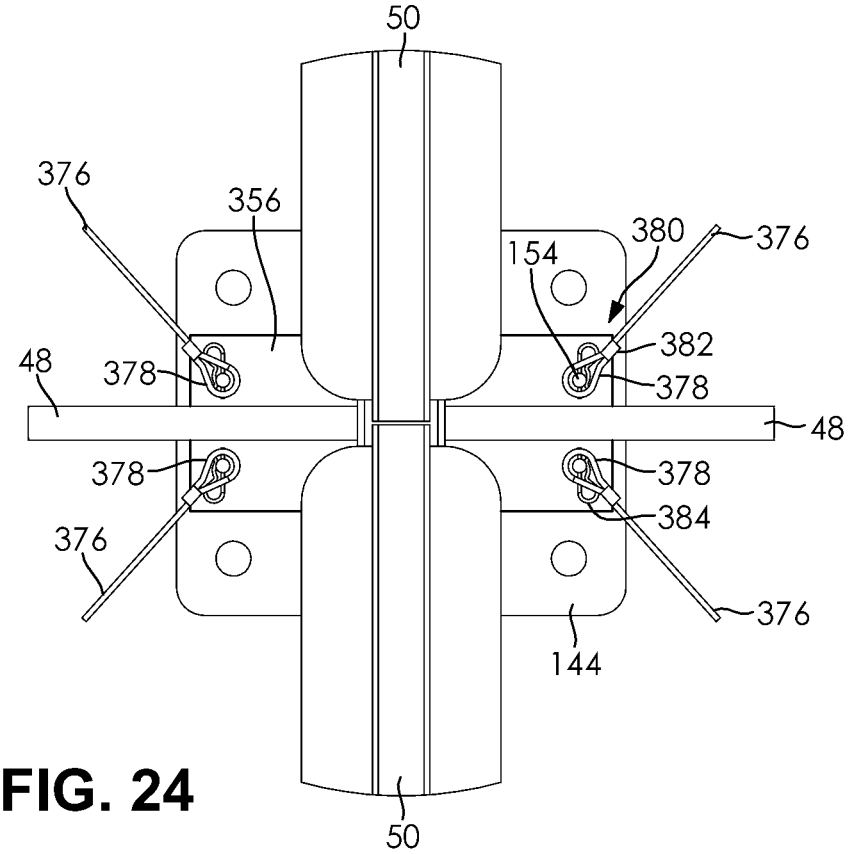
FIG. 24 is a top view of another embodiment of a portion of the system.
Figure 25:
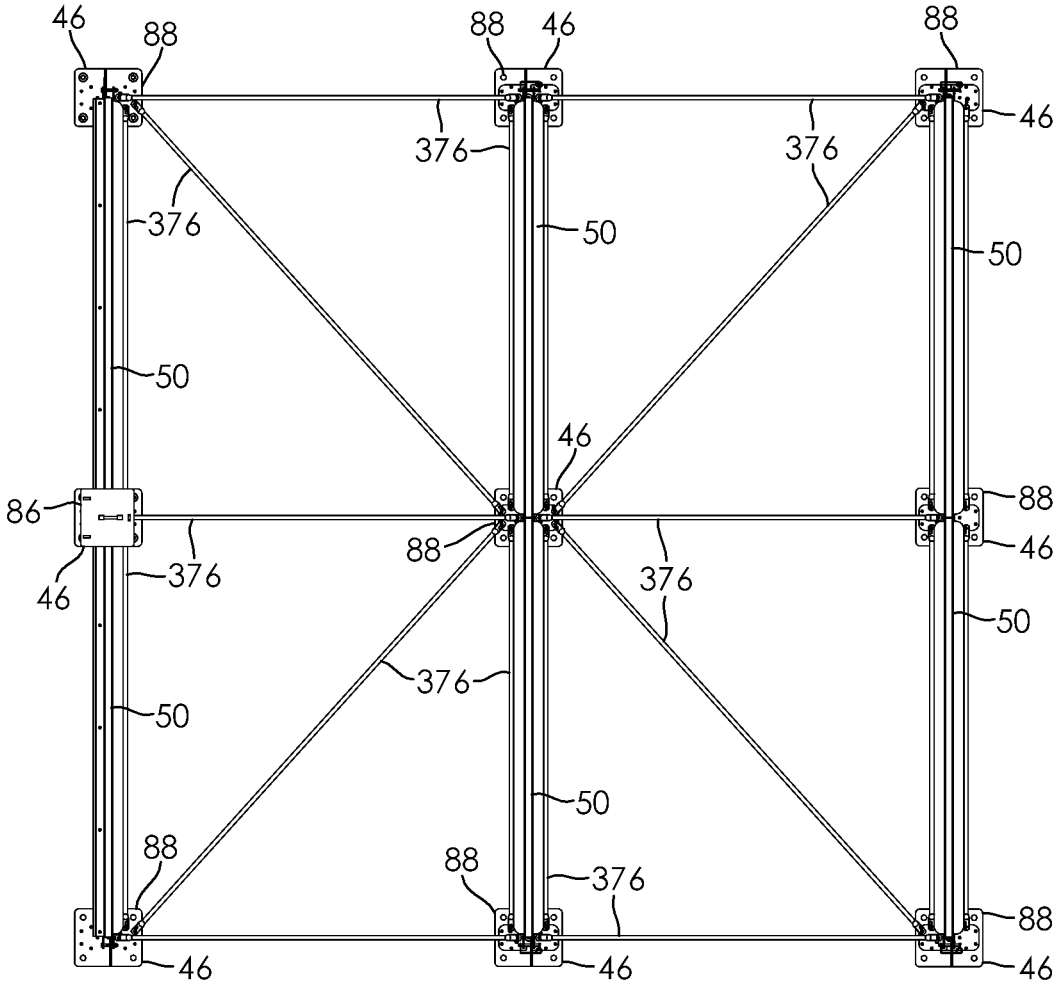
FIG. 25 is a top view of the structure from FIG. 24 implemented in the system.

Turning to FIGS. 24 and 25, another embodiment is depicted. Reference numbers used for structures described above are continued with this embodiment. In this embodiment one or more cables 376 may be used as hub connecting members 48. The cables 376 may be such as single or multi-strand steel cables, but other materials may be used. The cable 376 may be turned on itself to create a loop 378 on an end portion 380. The loop 378 may be secured such as with ferrule 382 or similar structure capable of securing the cable 376. The loop 378 created or defines an aperture in the cable 376.

As may be best seen in FIG. 24, the loops 378 may be located about the pins 154, such as on a ground saddle plate 144. Cotter pins 384 may be located through the pins 154 to prevent the loops 378 from moving off the pins 154. From FIG. 25 it can be appreciated that the cables 376 may be used in addition to other types of hub connecting members 48. The cables 376 may provide another device by which the hubs 46 may be connected together.

In accordance with the provisions of the patent statutes, the present device has been described in what is considered to represent its preferred embodiments. However, it should be noted that the device can be practiced otherwise than as specifically illustrated and described without departing from its spirit or scope.

What is claimed is:

1. A floor structure system, comprising:

a first hub having at least one pin and a first beam connector;

a second hub having at least one pin and a second beam connector;

at least one hub connecting member having a first end portion and a second end portion, wherein the first end portion has an aperture adapted to receive the at least one pin of the first hub and wherein the second end portion has an aperture adapted to receive the at least one pin of the second hub, and a beam having a first end portion and a second end portion, wherein one of the end portions is attached to one of the hubs, wherein the first and second hubs each have a plurality of pins, wherein each of the plurality of pins comprises first and second pin groups, wherein the groups are separated by the respective beam connectors.

2. The system of claim 1, wherein the at least one pins of the first and second hubs have circular cross sections and are all of substantially equal height above upper surfaces of the hubs.

3. The system of claim 1, wherein each of the pin groups have two leading pins, two middle pins and a single rear pin.

4. The system of claim 3, wherein the two leading pins of each of said pin groups are aligned with one another, the two middle pins in each of the pin groups are aligned with one another and the single rear pins in the pin groups are aligned with one another.

5. The system of claim 1, wherein the beam connectors comprise two equally spaced apart parallel plates, wherein fasteners extend through apertures in the parallel plates and the beam to secure them together.

6. The system of claim 5, wherein the beam has an upper surface, an opposite lower surface and two parallel side surfaces, wherein the side surfaces are located parallel and within the parallel plates.

7. The system of claim 6, wherein the beam comprises lips that extend transversely from the sides of the beam, wherein the lips are located above the pins and above the beam connectors.

8. The system of claim 1, wherein when the hub connecting member is at least one rod, the rod has a longitudinal rod axis, wherein the first and second end portions are offset from the longitudinal rod axis, and when the hub connecting member is a cable, the cable has a longitudinal cable axis coaxial the first and second end portions.

9. The system of claim 8, wherein the aperture in the first and second end portions in the rod are located in flat plate portions of the rod, and the at least one aperture in the first and second end portions for the cable are formed by loops in the cable.

10. The system of claim 1, wherein the hub connecting member is a first rod or cable extending transverse the beam and connects with a first pin in the first hub, a second and third rod or cable connect with second and third pins, respectively, on the first hub and extend between 30-60 degrees from the beam.

11. The system of claim 1, further comprising a gable upright connector comprising a lower portion and an upper portion, wherein the lower portion defines at least one jaw and a stop plate, wherein the at least one jaw and the stop plate are adapted to at least partially receive the beam between them, wherein the upper portion has an eye bolt aperture and a upright pin aperture extending transverse the eye bolt aperture.

12. A floor structure system, comprising:

a first hub having a first beam connector, wherein the first hub has at least one pin adapted to connect with a first rod or a first cable;

a second hub having a second beam connector, wherein the second hub has at least one pin adapted to connect with the first rod, the first cable, another rod or another cable;

wherein the rods or cables have an aperture adapted to receive at least one of the pins of either the first or second hubs, a beam having a first end portion and a second end portion, wherein one of the end portions is attached to one of the first or second beam connector, wherein said first or second beam connectors comprise two parallel plates separated by a gap and extending in the same upward direction as the at least one pin and on the same surface of the at least one pin on a respective hub.

13. A floor structure system, comprising:

a hub having a plate with an upper surface, wherein a beam connector is connected to said upper surface, and wherein at least one pin extends from the upper surface, the at least one pin adapted to connect with a rod or a cable extending generally transverse the pin direction, wherein the rod or cable has an aperture adapted to receive the at least one pin, and a beam attached to the beam connector, wherein said beam connector comprises two parallel plates separated by a gap and extending in the same upward direction as the at least one pin and on the same surface of the at least one pin.

* * * * *